US009919782B2

(12) United States Patent
Woody

(10) Patent No.: US 9,919,782 B2
(45) Date of Patent: Mar. 20, 2018

(54) WATERCRAFT ADJUSTABLE SHAFT SPACING APPARATUS AND RELATED METHOD OF OPERATION

(71) Applicant: Platinum Marine Inc., Pinconning, MI (US)

(72) Inventor: Clark M. Woody, Pinconning, MI (US)

(73) Assignee: Platinum Marine, Inc., Pinconning, MI (US)

( * ) Notice: Subject to any disclaimer, the term of this patent is extended or adjusted under 35 U.S.C. 154(b) by 0 days.

(21) Appl. No.: 15/622,819

(22) Filed: Jun. 14, 2017

(65) Prior Publication Data

US 2018/0009518 A1 Jan. 11, 2018

Related U.S. Application Data

(63) Continuation-in-part of application No. 15/464,592, filed on Mar. 21, 2017, now Pat. No. 9,758,225, which is a continuation of application No. 15/411,511, filed on Jan. 20, 2017, now Pat. No. 9,708,045.

(60) Provisional application No. 62/358,334, filed on Jul. 5, 2016, provisional application No. 62/362,829, filed on Jul. 15, 2016, provisional application No. 62/370,031, filed on Aug. 2, 2016.

(51) Int. Cl.

| | |
|---|---|
| ***B63H 5/125*** | (2006.01) |
| ***B63H 20/18*** | (2006.01) |
| ***B63H 21/14*** | (2006.01) |
| ***B63H 23/06*** | (2006.01) |

(52) U.S. Cl.
CPC ..... *B63H 20/18* (2013.01); *B63H 5/125* (2013.01); *B63H 21/14* (2013.01); *B63H 23/06* (2013.01); *B63B 2758/00* (2013.01); *B63H 2023/062* (2013.01)

(58) Field of Classification Search
CPC ..... B63H 21/14; B63H 5/125; B63H 23/06
See application file for complete search history.

(56) References Cited

U.S. PATENT DOCUMENTS

| | | | | |
|---|---|---|---|---|
| 1,780,552 A | | 11/1930 | Coggins et al. | |
| 2,667,087 A | * | 1/1954 | Myers | F16H 48/142 180/9.22 |
| 2,705,468 A | * | 4/1955 | Dix | B63H 5/08 114/274 |
| 2,957,441 A | * | 10/1960 | Leipert | B63H 20/10 440/56 |

(Continued)

*Primary Examiner* — Stephen P Avila
(74) *Attorney, Agent, or Firm* — Warner Norcross and Judd, LLP

(57) ABSTRACT

An outdrive for a marine vessel, such as a watercraft having an inboard engine, is provided. The outdrive can include a standoff box joined with a drive unit having a driveshaft that rotates in response to rotation of an input shaft coupled to an engine within a hull of the watercraft. The drive unit includes a propeller shaft that rotates in response to rotation of the driveshaft, and an associated propeller. The drive unit is vertically movable from a raised mode to a lowered mode, in which the propeller shaft is a preselected distance from a bottom of the boat hull, thereby lowering a thrust point produced by the propeller, all while the watercraft is moving through water and while the propeller is producing thrust. A related method and standoff box are also provided.

20 Claims, 13 Drawing Sheets

(56) References Cited

U.S. PATENT DOCUMENTS

| | | | | | |
|---|---|---|---|---|---|
| 3,626,467 | A | * | 12/1971 | Mazziotti | B63H 20/10 440/112 |
| 4,244,454 | A | | 1/1981 | Bankstahl | |
| 4,544,362 | A | | 10/1985 | Arneson | |
| 4,565,532 | A | | 1/1986 | Connor | |
| 4,645,463 | A | | 2/1987 | Arneson | |
| 4,728,308 | A | | 3/1988 | Weismann | |
| 4,764,032 | A | | 8/1988 | Tanaka | |
| 4,775,342 | A | | 10/1988 | Connor et al. | |
| 4,790,782 | A | | 12/1988 | McCormick | |
| 4,815,996 | A | * | 3/1989 | Carr | B63H 5/125 440/53 |
| 5,326,294 | A | | 7/1994 | Schoell | |
| 5,415,576 | A | | 5/1995 | Meisenburg et al. | |
| 5,647,780 | A | | 7/1997 | Hosoi | |
| 5,791,954 | A | | 8/1998 | Johnson, Jr. | |
| 5,863,230 | A | | 1/1999 | Morrison | |
| 5,934,955 | A | | 8/1999 | Heston | |
| 5,964,627 | A | | 10/1999 | Detwiler | |
| 6,383,043 | B1 | | 5/2002 | Heston | |
| 6,431,927 | B1 | | 8/2002 | Sage | |
| 6,468,119 | B1 | | 10/2002 | Hasl et al. | |
| 6,523,655 | B1 | | 2/2003 | Behara | |
| 6,960,107 | B1 | | 11/2005 | Schaub et al. | |
| 7,163,427 | B1 | | 1/2007 | Lee | |
| 7,985,109 | B2 | | 7/2011 | Mansfield et al. | |
| 2009/0117791 | A1 | | 5/2009 | Huddleston | |

* cited by examiner

WATERCRAFT ADJUSTABLE SHAFT SPACING APPARATUS AND RELATED METHOD OF OPERATION

BACKGROUND OF THE INVENTION

The present invention relates to watercraft, and more particularly to a watercraft outdrive that can move a propeller and its shaft relative to a watercraft bottom while the watercraft is under power.

There is a variety of watercraft used in different activities. Some watercraft is used for commercial purposes, while others are used for recreation and/or competition. Many watercraft or boats are constructed to include an inboard motor. In such a construction, the engine of the boat is located inside the hull of the boat, while an outdrive projects rearward from the stern of the boat. The outdrive typically includes a transmission that transfers rotational forces from the engine to a propeller shaft and an associated propeller. Upon rotation, the propeller produces thrust to propel the boat through water.

Conventional outdrives of inboard watercraft typically are constructed so that the outdrive can tilt about a pivot point to tilt the propeller upward or tilt the propeller downward. Upon such tilting, however, the angle of the propeller and the associated thrust changes significantly. For example, when an outdrive is tilted upward, the tilted angle of the propeller makes maneuvering the boat more difficult because the thrust is projected upward toward the water surface instead of being projected rearward, behind the boat.

Even with such tilt features, an issue with conventional outdrives of inboard watercraft is that the vertical displacement of the propeller shaft and propeller is generally fixed and immovable relative to the bottom of the watercraft. With this fixed relationship relative to the bottom of the watercraft, conventional outdrives fail to effectively provide vertical adjustment of the propeller shaft and propeller, and thus the thrust point.

The fixed relationship of the propeller shaft relative to the bottom of the boat also presents challenges to boat builders. To mount a standard drive at the surface of water, the builder will mount the engine higher within the hull of the boat. This in turn raises the center of gravity of the boat, and in some cases, makes it unstable. Raising the center of gravity also can impair the boat's handling characteristics. This can create issues, particularly when the boat turns at high-speed.

With a given height of the engine above the bottom of the boat, boat builders also struggle to identify the ideal propeller shaft location relative to the bottom of the boat when setting it in that fixed, permanent position. Usually, the builder uses trial and error techniques to place the propeller shaft at a particular location. Some boat builders and consumers will attempt to change the location of the propeller shaft relative to the bottom of the boat. For example, a consumer might purchase an outdrive lower unit that differs from the OEM lower unit offered at a standard height. These outdrive lower units typically enable the user to adjust the propeller shaft location in one inch increments.

An issue with modifying the outdrive to replace one lower unit for another is that this modification must be done by disassembling the outdrive and its components out of the water. This can be time-consuming and expensive. Users also can utilize spacer plates that are placed between upper and lower units of the outdrive. Again, however, the final set up of the spacer plate and/or different lower unit is fixed and cannot be changed without disassembling the lower unit to add or subtract a spacer plate or to replace the lower unit altogether with a different sized lower unit.

Another complicating factor in finding the ideal propeller shaft location is that the configuration and loading of the watercraft can change what that ideal propeller shaft location should be. For example, when a watercraft is loaded with gear and occupants on board, this can alter the ideal propeller shaft location. Full or empty fuel tanks also can change the location.

Further, with a fixed and immovable propeller shaft location, conventional outdrives can limit performance, particularly in race boats. Race boats typically run the propeller shaft at the surface of the water when the boat is under power to maximize speed. When the race boat turns around an obstacle, such as a buoy, at speed, less skeg of the outdrive is in the water. With less skeg in the water, the boat is more prone to skim the surface of the water and potentially spin out. In some cases, this can create a dangerous situation for the racers as well as observers.

Surface drive boats with a fixed and immovable propeller shaft location also are difficult to maneuver around a dock or other obstacle where a reverse direction is helpful. For example, surface drive propellers, when in reverse, thrust water against the stern, and in particular the transom of the boat. This helps very little to propel the boat rearward because this thrust is wasted.

Accordingly, there remains room for improvement in the field of outdrives for watercraft with inboard motors.

SUMMARY OF THE INVENTION

An outdrive for a marine vessel, such as a watercraft, that can move a propeller and its shaft relative to a watercraft bottom while the vessel is under power is provided.

In one embodiment, the outdrive is joined with a watercraft having an inboard engine. The outdrive can include a standoff box having a transfer shaft that rotates in response to rotation of an input shaft coupled to the inboard engine. The standoff box can include a secondary shaft that rotates in response to rotation of the transfer shaft, and subsequently rotates a drive shaft of a drive unit. The drive unit includes a propeller shaft and an associated propeller that rotate in response to rotation of the driveshaft. The drive unit is vertically movable relative to the standoff box.

In another embodiment, the drive unit is movable from a raised mode, in which the propeller shaft is a first distance from a reference line extending rearward from the transom, to a lowered mode, in which it is a second distance, greater than the first distance, from the reference line. This lowers a thrust point produced by the propeller, all while the watercraft is moving through water and while the propeller is producing thrust.

In a further embodiment, the drive unit moves relative to the standoff box so that in both the raised mode and the lowered mode, the propeller shaft is maintained at a fixed angle relative to a reference line projecting rearward from a bottom of a transom of the watercraft. In this manner, the propeller shaft is inhibited from and generally does not tilt longitudinally relative to the reference line. Instead, the propeller shaft simply moves vertically, upward and downward, while maintaining a fixed spatial orientation relative to the transom and a reference line.

In another embodiment, the outdrive can be equipped with a tilt assembly configured to tilt the outdrive up and down relative to the transom or hull of the watercraft. The tilt assembly can include a tilt actuator joined with the drive unit. The tilt actuator can extend to tilt the drive unit upward thereby changing the angle of the propeller shaft relative to the reference line. The tilt actuator can retract to tilt the drive unit downward, thereby changing the angle of the propeller shaft relative to the reference line. This tilting action is different from the vertical adjustment of the propeller shaft placement when the drive unit is moved from the raised mode to the lowered mode or vice versa. In the latter case, the propeller shaft can be maintained at a fixed angle relative to the bottom of the watercraft and/or the reference line all during the vertical movement of the drive unit relative to the standoff box.

In even another embodiment, the outdrive can include a drive assembly. The drive assembly can include moving components in the standoff box, as well as in the drive unit, that ultimately rotate the propeller shaft in response to rotation of the input shaft extending from the engine.

In still another embodiment, the drive assembly can include, in the standoff box, the transfer shaft rotatably coupled to the input shaft and to the secondary shaft. The secondary shaft can be rotatable in response to rotation of the transfer shaft, and can extend from the standoff box and into the drive unit, where it is rotatably coupled to the drive shaft.

In yet another embodiment, the drive assembly can include a transfer shaft configured to linearly extend to a longer length and retract to a shorter length. The transfer shaft can include sliding connection that is configured to enable a first transfer shaft portion and a second transfer shaft portion to slide relative to one another and achieve the different lengths of the transfer shaft when the drive unit is moved. This can enable the drive assembly to remain intact and transfer rotational forces to the drive shaft.

In another embodiment, the drive assembly can include a spline connection associated with the transfer shaft and configured to enable ends of the transfer shaft to move linearly toward and away from one another along a transfer shaft longitudinal axis. For example, the transfer shaft can include a first shaft portion and a second shaft portion joined via a spline connection. The first shaft portion and second shaft portion are linearly movable relative to one another along a transfer shaft longitudinal axis, enabling the transfer shaft to dynamically change in length as the drive unit moves to either of the raised mode or lowered mode.

In another embodiment, the first transfer shaft portion includes a spline, and the second transfer shaft portion defines a corresponding spline hole. The spline can be slidably disposed in the spline hole.

In yet another embodiment, the drive assembly can include a first articulating joint connector at a first end of the transfer shaft, and a second articulating joint connector at a second end of the transfer shaft, the second end distal from the first end. The first articulating joint connector can be joined with the input shaft, and the second articulating joint connector can be joined with the secondary shaft. Optionally, the first and second articulating joint connectors can be in the form of a universal joint, also referred to as a U-joint or a Cardan joint.

In still another embodiment, the drive assembly can include a ball spline joined with the transfer shaft, between portions of the transfer shaft and/or articulating joint connector. The ball spline can be configured to enable the portions of the transfer shaft and/or any articulating connectors to move toward and away from one another, yet remain rotationally static relative to one another while the drive assembly is under power.

In a further embodiment, the drive assembly can include a bearing block movably disposed in the standoff box. The bearing block can be joined with the transfer shaft but non-rotatable within the interior of the housing. The bearing block can be linearly movable up and down a rearward wall of the standoff box, toward and away from a bottom wall of the standoff box. The bearing block can maintain the secondary shaft in a fixed spatial orientation, for example, parallel to the input shaft, or an upper or bottom wall of the standoff box, even while the drive unit is moved to the raised or lowered modes, and even while the transfer shaft changes angle relative to a bottom wall or one of the other shafts.

In yet another embodiment, the bearing block can include a secondary shaft mount bore and a bearing element mounted in the secondary shaft mount bore. The secondary shaft can be rotatably mounted in the bearing element and the secondary shaft mount hole. Again, the bearing block can maintain the secondary shaft at a constant angle relative to an input shaft, or an upper or bottom wall of the standoff box, when the drive unit moves from the raised mode to the lowered mode, and even while the transfer shaft changes angle relative to a bottom wall or one of the other shafts.

In still another embodiment, the outdrive can include a vertical adjustment assembly that moves the drive unit relative to the standoff box. This vertical adjustment assembly can include a spacing actuator, such as a hydraulic cylinder, that is joined with the drive unit as well as the standoff box. The spacing actuator can extend and retract, and thereby move the drive unit upward and downward. In turn, this alters the spacing between the propeller shaft and the reference line of the transom, or more generally the spacing of the propeller shaft relative to a lowermost portion and/or a bottom wall of the standoff box.

In still yet a further embodiment, a standoff box for a watercraft having an inboard engine is included in the outdrive. The standoff box can include a housing that defines an interior. The housing can include a transom facing wall, a bottom wall and a rearward wall. The transom facing wall can define an input shaft hole adapted to receive therethrough an input shaft extending from the inboard motor. The rearward wall can define a secondary shaft hole adapted to receive therethrough a secondary shaft extending to the drive unit. This secondary shaft hole can include a secondary shaft hole axis, and optionally can be in the form of an elongated, vertically oriented slot. Further optionally, the transverse facing wall and rearward wall can be non-parallel with one another, the rearward wall being substantially vertical and the transverse facing wall being at an angle offset from vertical.

In a further embodiment, the standoff box of the outdrive can include a transfer shaft rotatably mounted in the housing, and dynamically movable relative to the input shaft so that the transfer shaft is disposable at multiple angles relative to the input shaft. The transfer shaft can include a transfer shaft longitudinal axis. The standoff box can include a secondary shaft extending from the housing through the secondary shaft hole. The secondary shaft can be movable linearly along the secondary shaft hole axis so that the secondary shaft is movable toward and away from the bottom wall of the housing as the secondary shaft rotates.

In even a further embodiment, a method of operating an outdrive is provided. The method can include: rotating an input shaft extending from a transom of a watercraft; rotating a transfer shaft coupled to the input shaft, the transfer shaft disposed in a standoff box having a bottom wall; rotating a secondary shaft coupled to the transfer shaft, the secondary shaft disposed in the standoff box; rotating a driveshaft coupled to the secondary shaft, the driveshaft disposed in an outdrive; rotating a propeller shaft coupled to the driveshaft, the propeller shaft joined with a propeller; and moving the propeller shaft away from the bottom wall a preselected distance while rotating the driveshaft and propeller shaft, the moving occurring while the propeller spins and the watercraft is moving through a body of water.

The current embodiments of the watercraft outdrive and related methods herein provide benefits in watercraft propulsion that previously have been unachievable. For example, where the outdrive is utilized on watercraft, the adjustability of the drive unit relative to the standoff box vertically allows an operator to lower a thrust point of the propeller to gain leverage and lift the bow of the watercraft. This can assist the watercraft in getting on plane more quickly. Further, with the vertical adjustability of the propeller shaft and drive unit in general, a user can adjust upward the thrust point after the watercraft is on plane to reduce drag and increase efficiency and speed.

Where the outdrive is configured to selectively vertically adjust thrust point and general orientation of the propeller shaft, a boat manufacturer can mount an inboard engine in the boat at a lower position in the hull. This can lower the center of gravity of the watercraft, but with the adjustable outdrive, the watercraft can still operate the propeller at the surface of the water upon demand.

With the vertical spacing adjustability of the outdrive, the location of the propeller shaft and associated thrust point of the propeller can be changed without disassembling or otherwise mechanically modifying the outdrive. In addition, when the watercraft is loaded with gear, payload and occupants, which alters the buoyancy of the watercraft, an operator can adjust the outdrive, even when the watercraft is under power and moving through the water, to ideally set the propeller shaft location. The operator also can adjust the outdrive depending on the amount of fuel in fuel tanks on the watercraft.

The vertical spacing adjustability of the outdrive herein can enable a user to lower a propeller shaft when entering a turn. This can increase drag and slow the boat more quickly. With a lowering of the lower unit of the outdrive, the outdrive also has more skeg and surface area in the water, which can prevent the boat from spinning out when traversing turns at high speed. Accordingly, boats equipped with such an outdrive can traverse turns at a higher rate of speed. Further, after the boat leaves the turn and straightens its path, the user can raise the propeller shaft to again obtain a high rate of speed.

The vertical spacing adjustability of the outdrive herein can assist in movement of the watercraft in reverse. For example, a user can lower the lower drive unit to adjust the propeller shaft and propeller location relative to the bottom of the watercraft. In effect, the lower unit can be lowered so that the propeller shaft and propeller are below the bottom of the watercraft, where the thrust can easily pass under the watercraft, rather than push against the transom of the watercraft.

The vertical spacing adjustability of the outdrive herein also can allow the outdrive to operate in shallow water. For example, with the outdrive, a user can raise the propeller shaft and propeller, which in turn can reduce the required water depth for operation without engaging the propeller against the bottom of the body of water, all while keeping the forward thrust produced by the propeller in line with the watercraft to maximize handling in the shallow water.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
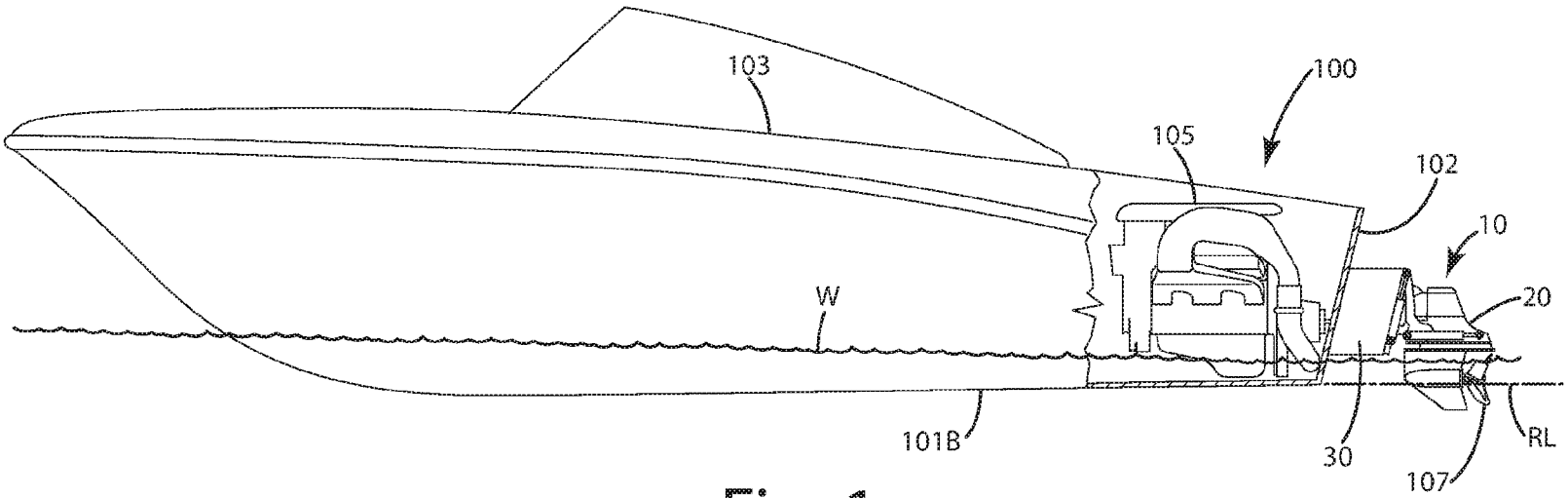
FIG. 1 is a side partial section view of a watercraft including an outdrive of the current embodiment with the outdrive in a neutral tilt mode and the drive unit in a raised mode.

A current embodiment of the watercraft outdrive is illustrated in FIGS. 1-7, and generally designated 10. As illustrated, the outdrive 10 is joined with a watercraft 100. Although shown as a high performance boat, the watercraft 100 with which the outdrive 10 is used can be any type of marine vessel, for example, a recreational boat, a racing boat, a pontoon boat, a fishing vessel, a tanker or other type of commercial vessel, a submarine, a personal watercraft, an amphibious vehicle, an underwater exploration vehicle, or virtually any other type of vessel that is propelled through or on water via a propeller.

The watercraft 100 includes a hull 101 having a stern 104 at which a transom 102 is located. The hull 101 also includes a bottom 101B. This bottom can coincide with or include a lowermost portion of the hull. The watercraft can include a reference line RL that extends rearward from the hull 101, and in particular, that extends from the lowermost portion of the transom 102 and/or bottom 101B, rearward from the boat. As used herein, this reference line RL is helpful in appreciating the spatial orientation of the propeller shaft 23, which includes its own longitudinal axis LA, relative to the lowermost portion of the transom and/or the bottom 101B of the watercraft.

Within the hull 101, an engine or motor 105 is disposed. With this configuration, the watercraft 100 is considered an inboard type of watercraft, where the engine is mounted inside the hull, rather than hanging off the back of the hull or otherwise disposed outside the hull. The engine is joined with an input shaft 106 that extends rearwardly from the engine and through a hole 102H in the transom 102. The hull hole 102H is sealed so that water cannot enter through the hole into the hull. A bearing (not shown) can be associated with the hull hole. The input shaft is rotated by the engine under force and generally is utilized to rotate the various components of the outdrive 10 and ultimately the propeller 107 as described below. Further, it will be understood that although referred to as an input shaft, this component can include multiple shafts or members connected to one another via different types of joints, such as universal joints. If there is more than one shaft connected to others, collectively, those shafts are still considered an input shaft.

The input shaft 106 extends rearward and is rotationally coupled to the components of the outdrive 10. Many components of the outdrive 10, as explained below, can be rotationally coupled to one another and directly or indirectly rotationally coupled to the input shaft 106. As used herein, rotatably coupled means that rotation of one element causes rotation of another element, regardless of whether the two elements are in direct contact with one another or have other elements therebetween, so that the two elements do not directly contact or engage one another during rotation.

The outdrive 10 can be mounted to the watercraft, and in particular, the transom 102. The outdrive 10 can include a drive unit 20 and a standoff box 30. The standoff box can interface directly with the transom 102 with a gasket or seal therebetween to prevent water from entering the input shaft hole 102H or other fastener holes used to connect the standoff box 30 to the transom. The standoff box can include the various components described herein to rotatably couple the input shaft 106 to a driveshaft 50DS of the drive unit 20. The drive unit 20 can be movably joined with the standoff box 30 via a gimbal ring 12 mounted to a mounting bracket 11. The mounting bracket 11 can be oriented to enable the input shaft 106 to extend between portions of it or through it, and directly to the outdrive unit 20. The mounting bracket can be outfitted with an armature or gimbal ring 12. This armature or gimbal ring can form a portion of a tilt assembly 40 as explained with further reference to FIGS. 3 and 4.

Figure 1A:
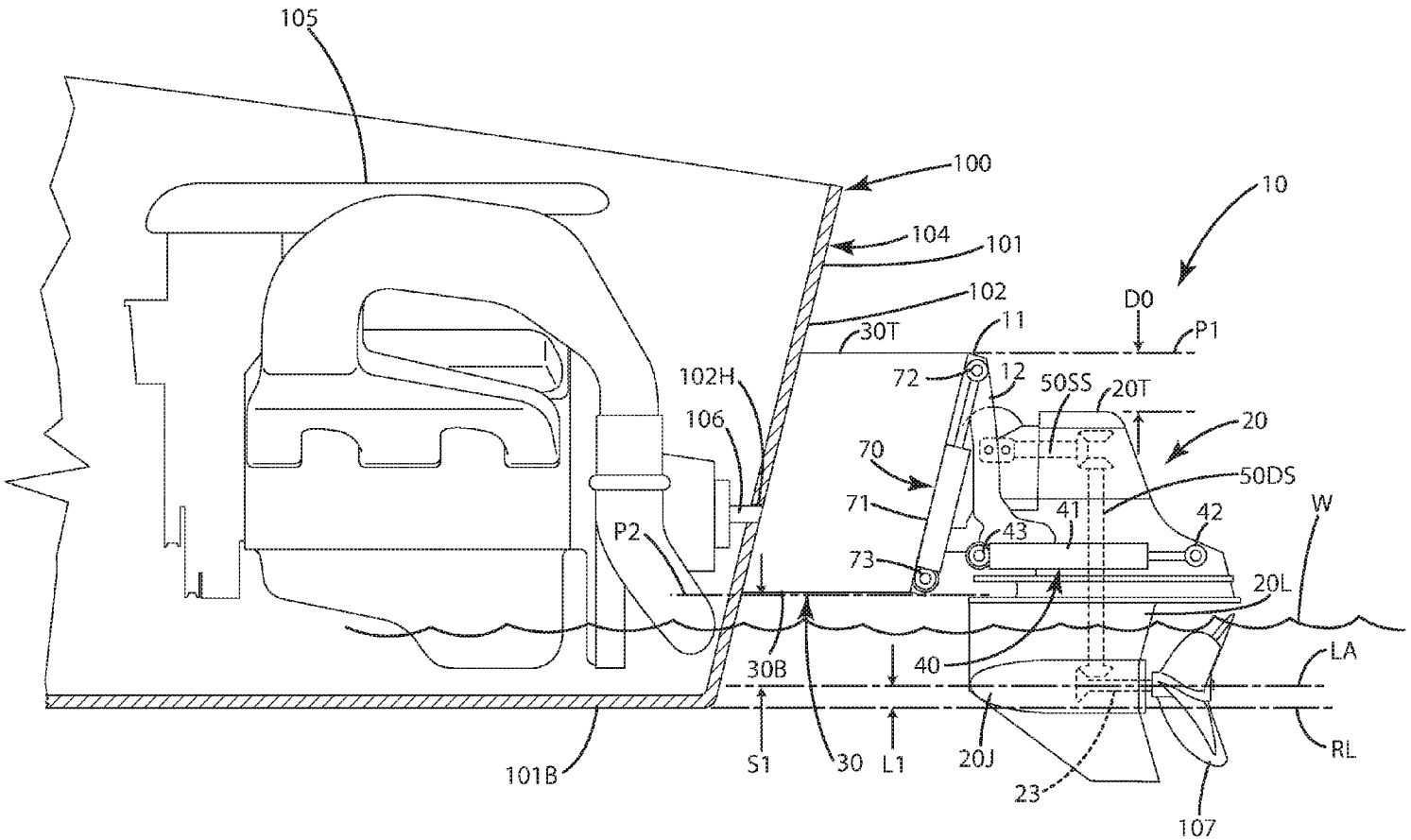
FIG. 1A is a close up section view of the watercraft and outdrive with the outdrive in a neutral tilt mode and the drive unit in a raised mode.

In particular, as shown in FIG. 1A, the tilt assembly 40 can include a tilt actuator 41 that can extend between the gimbal ring 12 and another portion of the outdrive 10. For example, the tilt actuator 41 can be joined pivotally with the gimbal ring 12 at one end 43, and at an opposite end 42, the tilt actuator can be joined with drive unit 20. The actuator 41 can be in the form of a hydraulic ram, pneumatic ram, or a set of gears. The tilt actuator 41 can be remotely operated by a user or operator of the watercraft 100 to extend and/or retract the actuator at its ends relative to one another. In so doing, the tilt assembly 40 operates to tilt the drive unit 20 relative to the watercraft.

Figure 3:
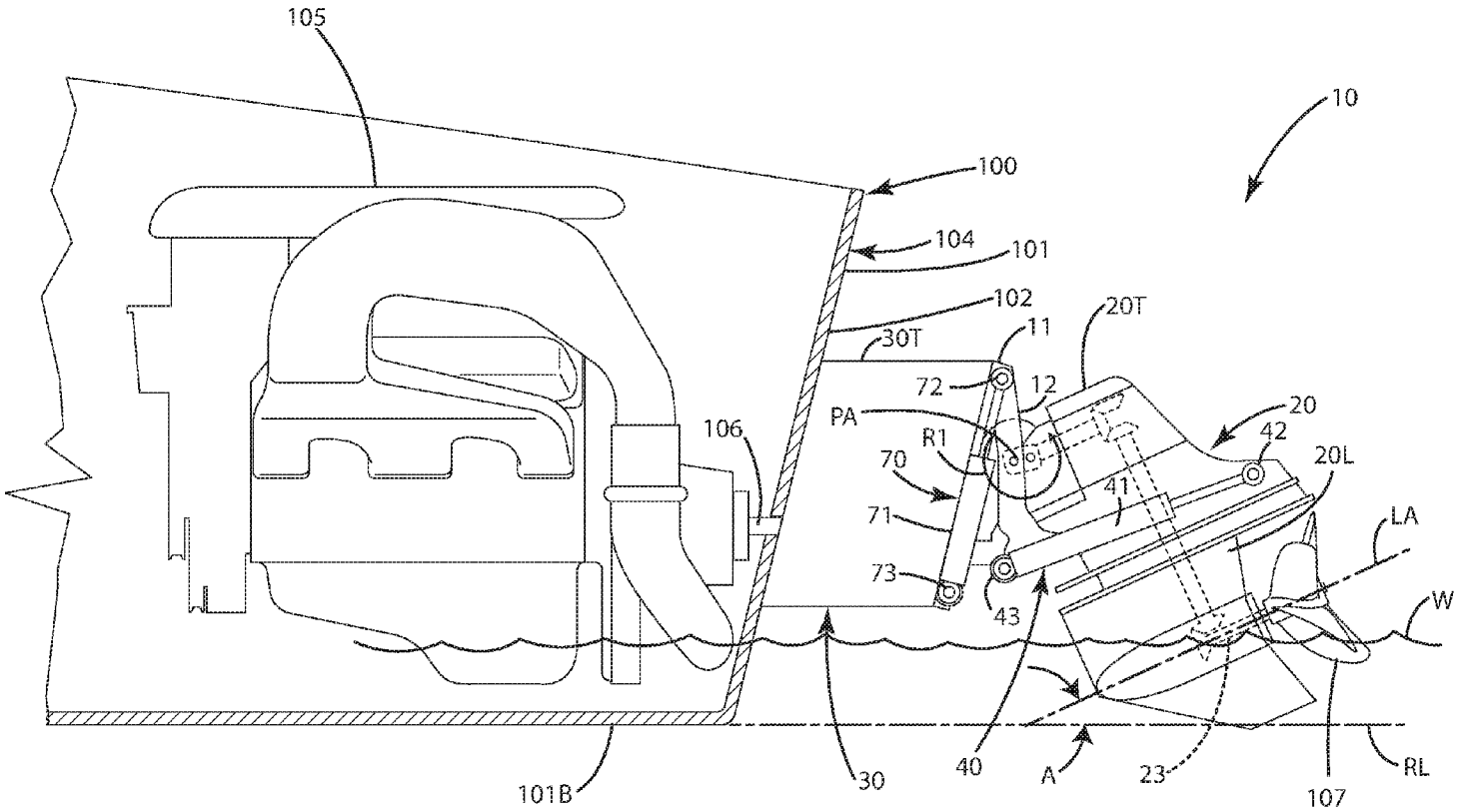
FIG. 3 is a side partial section view of a watercraft including an outdrive of the current embodiment, with the outdrive in an upward tilted mode and the drive unit in a raised mode.

In particular, the tilt assembly 40 can be operated to extend the tilt actuator 41 as shown in FIG. 3. In so doing, the actuator 41 effectively pushes and tilts the drive unit 20 upward. As the outdrive tilts, it pivots about one or more pivot axes PA, at which the drive unit 20 is attached to the gimbal ring 12 which is attached to the mounting bracket 11. When the outdrive tilts, for example, in direction R1 in FIG. 3, the orientation of the shaft propeller shaft 23 and its longitudinal axis LA attains an angle A that is offset relative to the reference line RL. This upwardly offset angle can vary, depending on the operator's intended propulsion utilizing the propeller 107. In most cases, this upward tilt angle A can be an acute angle.

The tilt assembly 40 can be adjusted so that the tilt is neutral, as shown in FIG. 1A. This can mean that the propeller shaft 23 and its longitudinal axis LA are parallel to a portion of the hull of the watercraft. For example, the longitudinal axis LA can be parallel to the reference line RL and/or to the bottom 101B of the watercraft when the tilt is neutral. Of course, when the tilt assembly 40 is actuated to tilt the outdrive using the tilt actuator 41, pivoting in direction R1 about axis PA, the outdrive 10 and its components, the drive unit 20, tilts upward changing the orientation of the propeller shaft 23 and its longitudinal axis relative to the reference line RL to some angle A as shown in FIG. 3.

Figure 4:
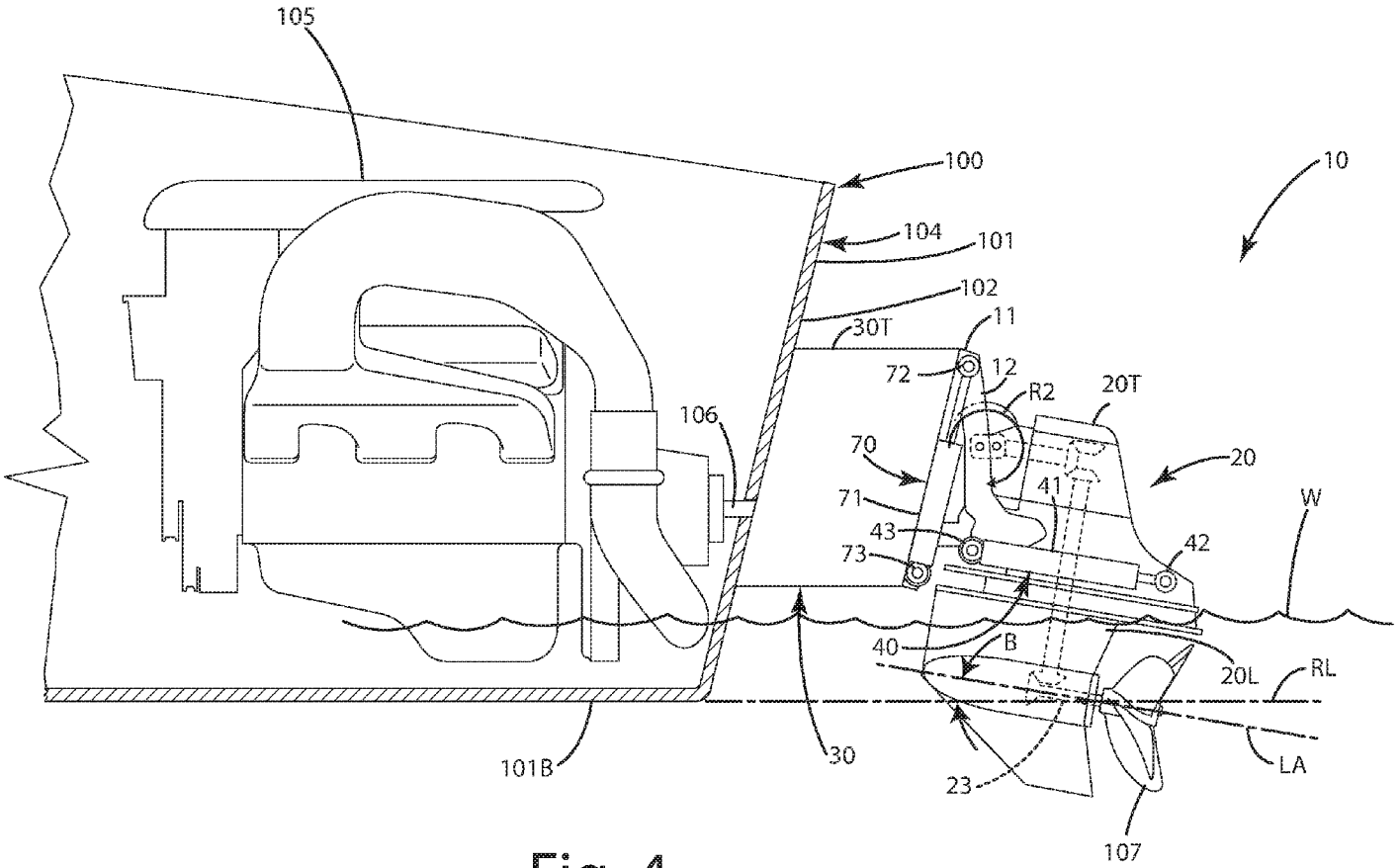
FIG. 4 is a side partial section view of a watercraft including an outdrive of the current embodiment, with the outdrive in an downward tilted mode and the drive unit in a raised mode.

As shown in FIG. 4, the tilt assembly 40 can also be adjusted so that the outdrive and propeller are tilted downward. For example, the tilt assembly 40 can actuate the tilt actuator 41 thereby bringing the ends 42 and 43 closer to one another. This actuator can be in the form of a ram or rod retracting into a hydraulic cylinder. This rotates the drive unit 20 about the pivot axis PA in direction R2. In so doing, the drive unit 20 can come closer to the bottom portion of the transom. Further, the propeller shaft 23 and its longitudinal axis LA tilts downward to an offset angle B relative to the reference line RL. This downwardly offset angle can vary, depending on the operator's intended propulsion utilizing the propeller 107. In most cases, this downward tilt angle B can be an acute angle.

In addition to the tilt assembly 40, the outdrive 10 of the current embodiment can include a drive assembly 50, a guide assembly 60 and a vertical adjustment assembly 70. All of these components can operate in concert to enable an operator to raise and lower the drive unit 20 relative to the standoff box, components thereof, and/or relative to the reference line RL. More particularly, the outdrive of the current embodiment is constructed so that the drive unit 20 can be operable in a raised mode as shown in FIG. 1A. There, the top 20T of the drive unit 20 is a vertical distance D0 from an upper surface of the standoff box 30. This distance D0 can be optionally 0, 1, 2, 3, 4, 5, 6 inches or increments thereof. Although illustrated with the top 20T below the upper surface of the standoff box, the top can in some cases and modes, be above that upper surface.

In this raised mode, the propeller shaft 23 and its longitudinal axis LA can be aligned in parallel to the reference line RL, particularly when the outdrive is in a neutral tilt position, as shown in FIG. 1A. In some cases, the longitudinal axis LA can be generally parallel to a plane within which the reference line RL lies in this raised mode. In this case, the longitudinal axis LA is offset 0 inches from the reference line RL. In other cases, the longitudinal axis LA can be disposed a preselected distance L1, for example 0, 1, 2, 3, 4, 5, 6 inches or increments thereof above the reference line RL. Optionally, the longitudinal axis LA can be disposed a small preselected distance L1, for example 0, 1, 2, 3, 4, 5, 6 inches or increments thereof below the reference line RL in the raised mode shown in FIG. 1A.

Optionally, when the outdrive is in the raised mode, the propeller shaft 23, and particularly its longitudinal axis LA, is disposed a first distance S1 (FIG. 1A) from the standoff box, and in particular, from the plane P2 in which the lowermost portion of the standoff box and/or lower wall 30B lays. This first distance S1 can extend, for example 0, 1, 2, 3, 4, 5, 6, 7, 8, 9, 10, 12, 24 inches or increments thereof, below the plane P2.

Figure 2:
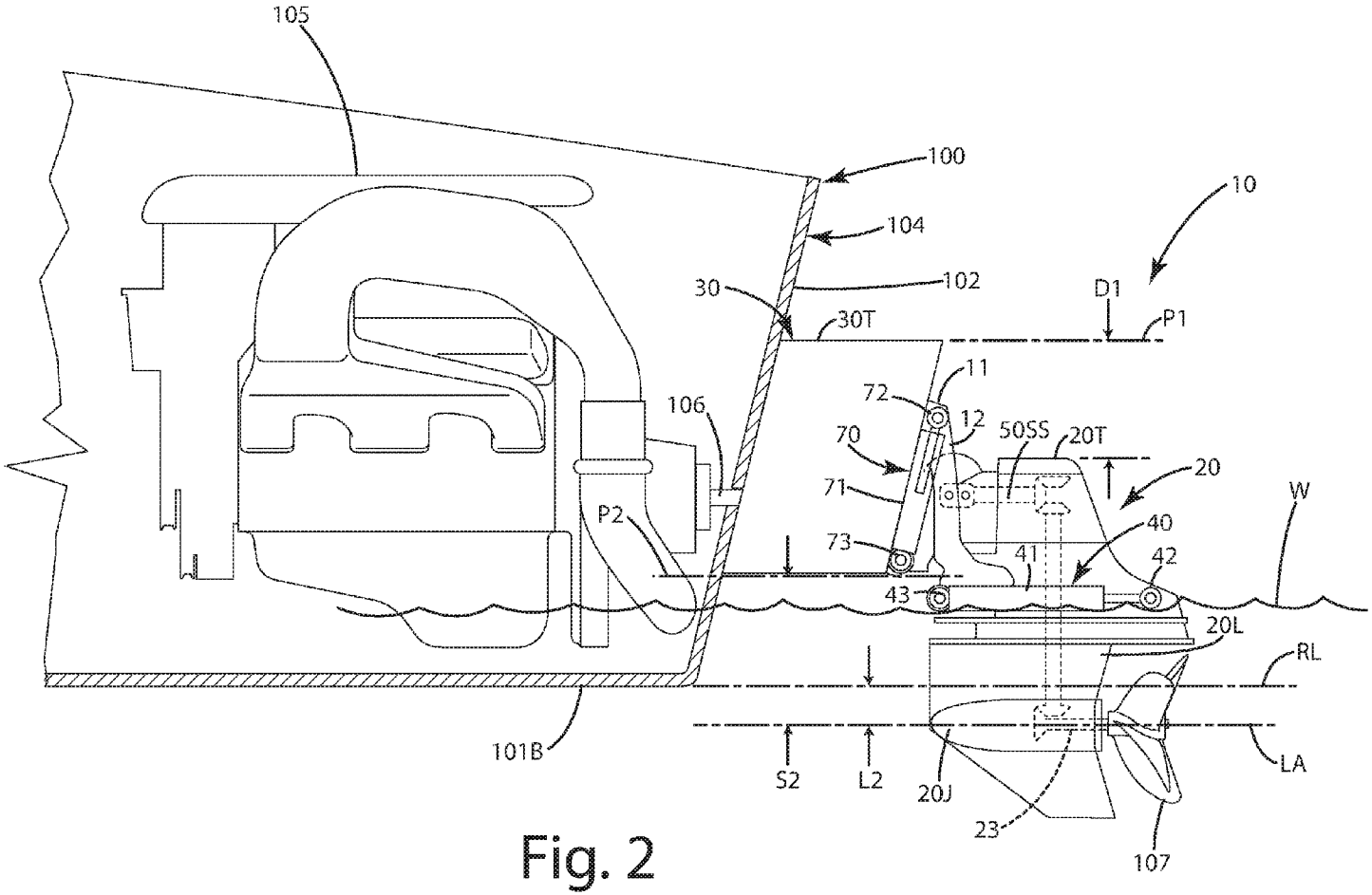
FIG. 2 is a side partial section view of the watercraft including the outdrive, with the outdrive in a neutral tilt mode and the drive unit in a lowered mode.

The drive unit 20 can be guided and urged with the vertical adjustment assembly 70 to a lowered mode as shown in FIG. 2. In this lowered mode, the top 20T of drive unit 20 moves downward relative to the upper wall 30T of the standoff box 30, in the plane P1 within which the uppermost portion of the standoff box and/or the upper wall lays, to a preselected distance D1. In effect, this distance D1 can be greater than D0. D1 can be optionally 0, 1, 2, 3, 4, 5, 6, 7, 8, 9, 10, 12, 24 inches or increments thereof.

In this lowered mode, the propeller shaft 23 and its longitudinal axis LA can be aligned in parallel to the reference line RL, particularly when the outdrive is in a neutral tilt position, as shown in FIG. 2. In some cases, the longitudinal axis LA can be parallel to a plane within which the reference line RL lies in this lowered mode. In other cases, the longitudinal axis LA can be disposed a preselected distance L2, for example 0, 1, 2, 3, 4, 5, 6 inches or increments thereof below the reference line RL. Optionally, the longitudinal axis LA can be disposed a small preselected distance L2, for example 0, 1, 2, 3, 4, 5, 6 inches or increments thereof above the reference line RL in the raised mode shown in FIG. 1A.

Optionally, when the outdrive is in the lowered mode, the propeller shaft 23, and particularly its longitudinal axis LA, is disposed a second distance S2 (FIG. 2) from the standoff box, and in particular, from the plane P2 in which the lowermost portion of the standoff box and/or lower wall 30B lays. This second distance S2 can be greater than the first distance S1, for example 1, 2, 3, 4, 5, 6 inches or increments thereof greater than the first distance S1.

The drive unit 20 of the outdrive 10 is movable from the raised mode to the lowered mode while the watercraft 100 is moving through a body of water W and while the propeller shaft 23 and the propeller 107 are spinning and producing thrust to propel the boat in a direction. The drive unit 20 is movable vertically upward and downward (as opposed to being tilted upward or tilted downward) while the watercraft is moving through a body of water and while the propeller shaft 23 and the propeller 107 are spinning and producing thrust. Further, the spatial offset of the longitudinal axis LA from the distance L1 to a second, different distance L2 (in transitioning from the raised mode to the lowered mode) can all occur while the watercraft is under power and the propeller is spinning. Certain components of the drive assembly 50, for example the driveshaft, secondary shaft, bearing block, or other components as described below also can move relative to the standoff box upper wall 30T, and the plane P1 in which it extends, during the transition from the raised mode to the lowered mode and vice versa, all while the propeller is spinning and the watercraft is moving and/or under power.

During the movement of the drive unit 20 relative to the standoff box 30, for example, as shown in FIGS. 1A and 2, the spacing between the longitudinal axis LA of the propeller shaft 23 changes relative to the reference line RL. Again, in the raised mode the spacing between the reference line RL and the longitudinal axis LA of the propeller shaft 23 can be a distance L1 (FIG. 1A). When the drive unit 20 is vertically lowered relative to the standoff box 30, this vertical spacing changes so that the longitudinal axis LA of the propeller shaft 23 is spaced a second, optionally greater distance, L2 (FIG. 2) from the reference line RL. It will be noted that during this transitional movement and alteration of the spacing of the longitudinal axis LA of shaft 23 relative to the reference line RL, the longitudinal axis LA can maintain a constant angular orientation relative to the reference line RL (assuming that the tilt assembly is not simultaneously actuated during the raising and lowering).

Accordingly, assuming the tilt is neutral as shown in FIGS. 1 and 1A, when the drive unit 20 is moved to the lowered mode shown in FIG. 2, the longitudinal axis LA of the propeller shaft 23 remains in a parallel configuration relative to the reference line RL. If the outdrive is in an upward tilted mode as shown in FIG. 3, when lowering from a raised mode to a lower mode of the drive unit 20 occurs, the longitudinal axis LA of the propeller shaft 23 can be maintained at the offset angle A relative to the reference line RL throughout the vertical spacing adjustment or downward movement. If the outdrive 10 is in a downward tilted mode, as shown in FIG. 4, when lowering from a raised mode to a lowered mode of the drive unit occurs, the longitudinal axis LA of the propeller shaft 23 can be maintained at the offset angle B relative to the reference line RL throughout the vertical spacing adjustment or downward movement. Likewise, in the first operation, where the drive unit 20 is moved from the lowered mode to the raised mode, the reference line can maintain its angular orientation relative to the reference line RL throughout the movement.

The various components of the outdrive 10, for example the various housings, the drive unit 20, standoff box 30, the guide assembly 60, the vertical adjustment assembly 70 and the drive assembly 50 will now be described in more detail. As shown in the exploded view of FIGS. 5 and 6, the outdrive 10 can include a drive unit 20. The drive unit 20 can include a drive unit housing 20H within which are some components of the drive assembly. The drive unit can be constructed in upper and lower parts, depending on the application. A secondary shaft 50SS can extend out from the standoff box 30 and into the housing 20H, and can interface with the drive shaft 50DS as explained further below. The drive unit 20 can include an upper or top surface 20T which can generally form the uppermost portion of the housing. This top surface can be planar and/or rounded, and can pass within a plane associated with an uppermost extent of the housing 20H and/or the drive unit 20 in general.

Figure 5:
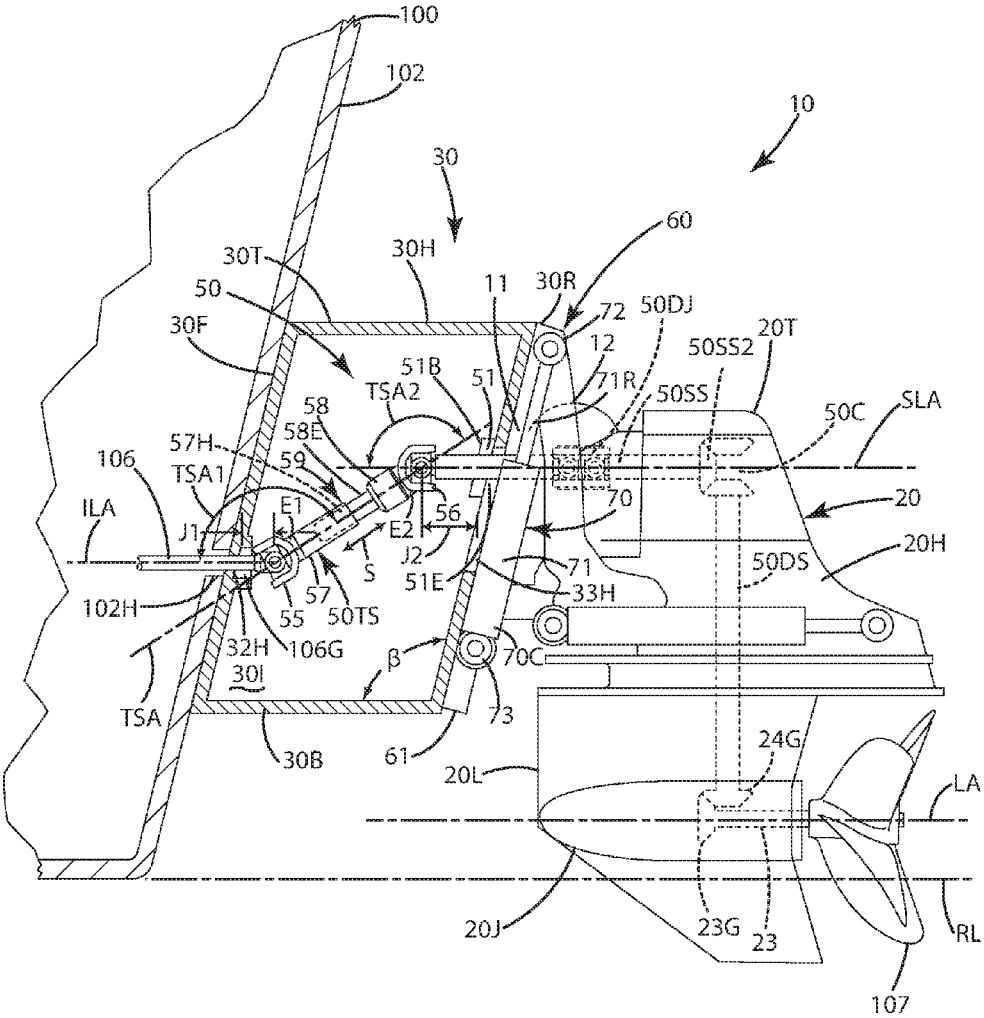
FIG. 5 is a side partial section view of a standoff box and drive assembly of the outdrive with the drive unit in a raised mode.

The drive unit 20 can include a lower portion 20L. As shown in FIG. 5, this lower portion can include a bullet or torpedo 20J that houses the propeller shaft 23 and associated gear 23G, which interfaces with the gear 24G that is connected to the driveshaft 50DS of the drive assembly 50.

The drive unit 20 can also include the propeller 107 which is fixedly and non-rotatably joined with the propeller shaft 23.

Figure 6:
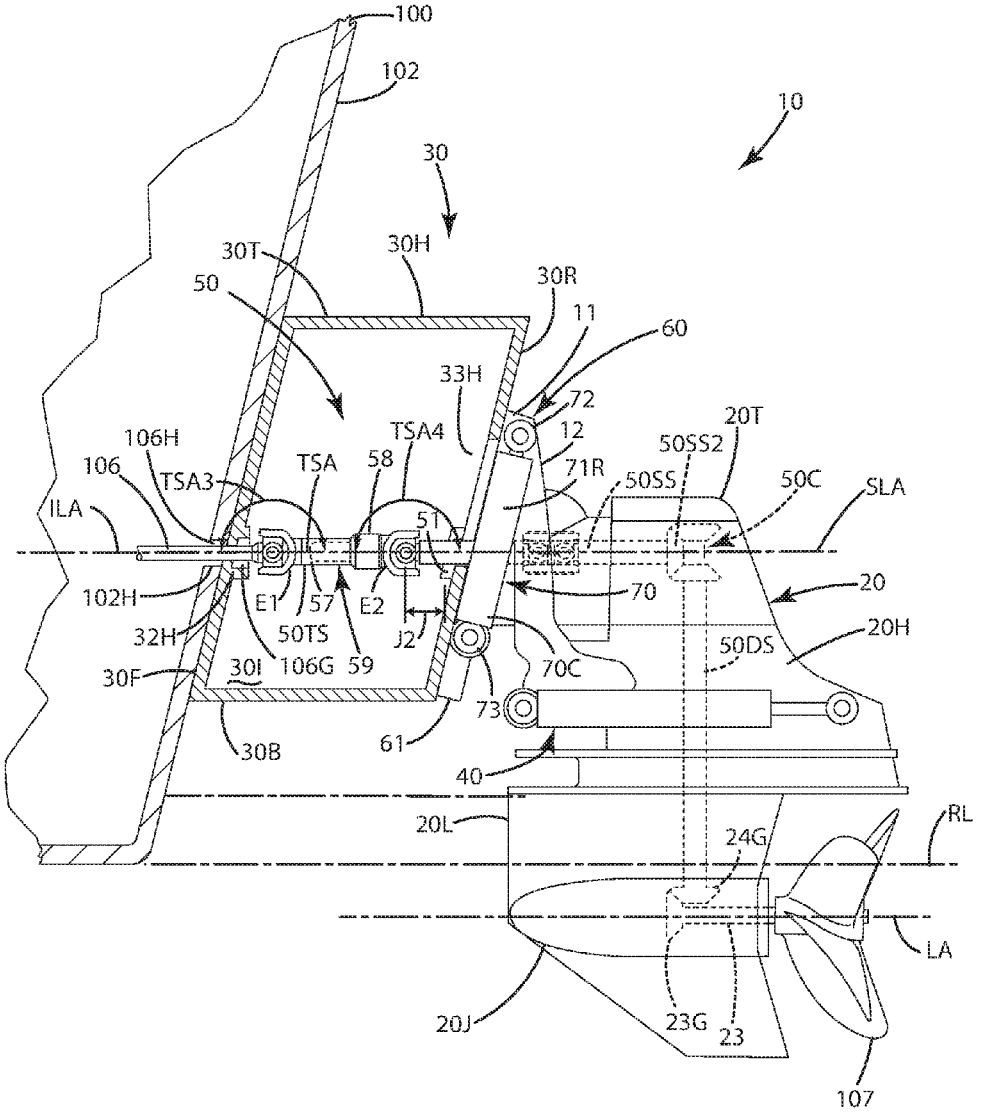
FIG. 6 is a side partial section view of the drive assembly of the outdrive with the drive unit in a lowered mode.

With reference to FIGS. 5-6, the components and operation of the guide assembly 60 and the vertical adjustment assembly 70 be described in further detail. To begin, the vertical adjustment assembly 70 is the component of the outdrive that moves the drive unit vertically, and generally relative to the standoff box 30. Depending on the particular application, the various components of the vertical adjustment assembly can be joined with the mounting bracket 11 and the standoff box 30 respectively. Further, the vertical adjustment assembly can be operated remotely, for example, from a cabin or at an operator station via electrical, manual, hydraulic pneumatic or other controls to provide the desired raising and/or lowering of the lower drive unit relative to the upper drive unit.

Figure 7:
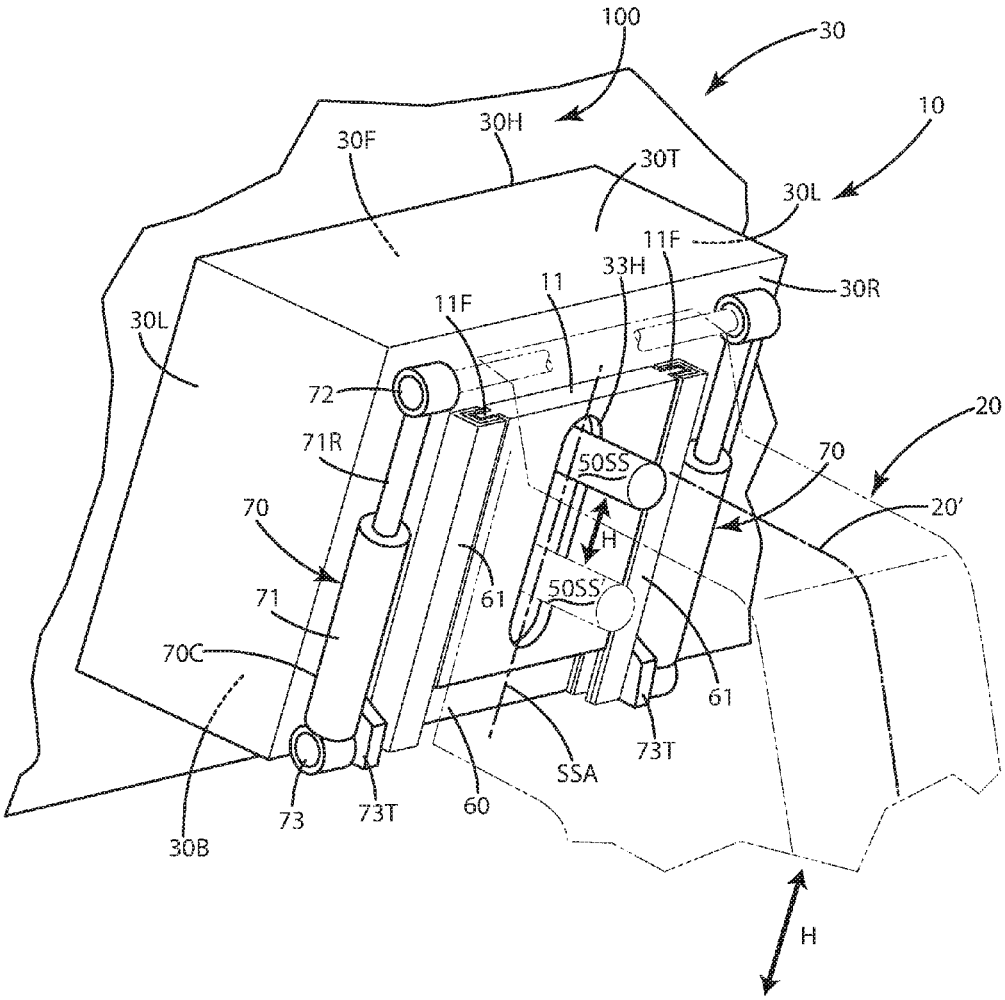
FIG. 7 is a rear view of the standoff box illustrating movement of the secondary shaft upon lowering of the drive unit.

As shown in FIGS. 5, 6 and 7, the vertical adjustment assembly 70 can include first and second actuators 71. As mentioned above these actuators 71 can be in the form of hydraulic, pneumatic or other types of cylinders with rams 71R that extend and retract relative to a main body or cylinder 70C. The amount of force with which the rams 71R extend and retract can vary depending on the particular application and the watercraft. The actuators 71 can be disposed symmetrically across from one another on opposite sides of the standoff box 30. This can provide a balanced application of force to raise and lower the drive unit 20 relative to the standoff box 30. Optionally, the left and right actuators 71 can be in a common fluid or hydraulic circuit so that the actuators simultaneously, consistently and evenly engage the mounting plate 11 to which the upper ends 72 of the rams 71R are attached to move it and the drive unit 20, along with all of its components, in an even and level manner upward and downward to and from the various modes. Lower ends 73 can be joined directly with the standoff box 30 via tabs 73T extending from the rearward wall 30R of the standoff box 30.

The guide assembly 60 can operate in concert with the vertical adjustment assembly 70 to provide a smooth, guided, and even consistent raising and lowering of the drive unit relative to the standoff box and boat in general. As shown in FIGS. 5, 6 and 7, the guide assembly 60 can include one or more guide channels 61, optionally attached to the standoff box, and in particular the rear wall 30R thereof. These guide channels can be C- or U-shaped channels configured to constrain flanges and/or edges 11F of the mounting bracket 11. In effect, the guide channels can guide the flanges 11F as they move upward and downward within the channels. Because the drive unit 20 is attached to the gimbal ring 12 which is attached to the mounting bracket 11, the drive unit 20 also moves vertically upward and/or downward when the flanges move upward or downward within the respective channels. Of course, other types of guides, such as rods, bars or the like can be substituted for the flanges/channels between the standoff box and the drive unit to provide a guiding interface so that the drive unit can move consistently and evenly in a non-binding manner relative to the standoff box, when moving from the raised mode to the lowered mode and vice versa.

Optionally, the precise location of the elements and components of the drive assembly and vertical adjustment assembly can be moved relative to one another about the drive unit 20 and the standoff box 30. Further, fewer or less of each respective component can be included in the outdrive 10, depending on the particular application. In some cases, it may be satisfactory to include only a single vertical adjustment assembly and associated actuator and a single system of guide channels and/or rods. In others, additional guide assembly components and vertical adjustment assembly components can be helpful.

As mentioned above, the outdrive 10 includes a drive assembly 50. This drive assembly is configured to enable the drive unit 20 to move upward and downward, vertically relative to the standoff box 30, while maintaining the input shaft 106 rotatably coupled to the propeller shaft 23. Accordingly, the drive unit 20 can be moved to a lowered mode and back to a raised mode, all while the drive assembly conveys rotational force to the propeller 107, and all while the boat is under power, moving through water.

Many components of the drive assembly 50 are disposed in or otherwise joined with the standoff box 30. The standoff box 30 can be in the form of an enclosed box or housing 30H defining an interior 30I. The box or housing can include an upper top wall 30T as described above and an opposing lower or bottom wall 30B. The standoff box 30 also can include a rearward wall 30R and opposing forward or transom facing wall 30F. The forward transom facing wall 30F can be bolted directly to the transom 102, such that the standoff box is stationary and/or fixed immovably to the transom 102 or the hull. Seals and/or gaskets can be disposed between the transom and the standoff box, as well as between the outdrive and the standoff box to prevent leakage of water into the hole and/or box. The forward and rearward walls can be parallel to one another as shown in FIGS. 1-7, as can be the upper and lower walls to one another, and the lateral walls to one another. Optionally, the rearward wall can be at an obtuse angle B relative to the bottom wall 30B, or at an acute angle relative to the bottom wall, or further optionally perpendicular to the bottom wall as shown in FIGS. 8-11, or any other angle depending on the application. For example, in the constructions shown in FIGS. 1-7, the rear wall 30R can be modified to be perpendicular to the bottom wall and/or upper wall, or generally vertical and non-parallel to the transom facing wall 30F, as shown in FIGS. 8-11. In some applications, this can reduce the angles TSA1, TSA2 of the spline shaft axis TSA relative to the axes of the other shafts, and thus place less stress on the universal joint connecting the respective shafts. Lastly, even though the rear wall 30R is shown as slanted in FIG. 7, the principle of operation of that wall, and the other rear walls at other angles relative to the bottom wall in the other figures is similar.

The forward transom facing wall 30F can define an input shaft hole 32H adapted to receive there through the input shaft 106. The input shaft hole 32H can be aligned with the hull hole 102H. The rearward wall 30R can define a secondary shaft hole 33H adapted to receive there through a secondary shaft 50SS. The secondary shaft hole 33H as illustrated in FIG. 7, can be in the form of an elongated slot which can be substantially vertically oriented, and/or oriented at an angle relative to vertical in some applications. This elongated slot can include a secondary shaft hole axis SSA, which is generally parallel to the longest and/or largest dimensioned of the hole 33H. This axis SSA can be vertical and optionally parallel to the lateral sidewalls 30L of the standoff box 30, or it can be slanted as shown in FIG. 7, slightly offset from vertical but optionally parallel to the front wall 30F. As explained further below, the secondary shaft 50SS, extending from the standoff box to the drive unit, can be movable nearly along and/or parallel to the secondary shaft hole axis SSA so that the secondary shaft moves toward and/or away from the bottom wall 30B of the housing 30H as the secondary shaft rotates and is rotatably coupled to the input shaft. As shown in FIG. 7, the secondary shaft 50SS is in an upward position relative to the hole 33H when the drive unit 20 is in the raised mode. As shown in broken lines, the secondary shaft 50SS' moves to a lowered position in the hole when the drive unit 20 is in the lowered mode.

With reference to FIGS. 5 and 6, the drive assembly 50 includes multiple shafts that are rotationally coupled to one another via articulating joint connectors. To begin, in FIG. 5, the drive assembly 50 and its components are rotated via the input shaft 106 that extends through the transom 102 of the watercraft 100 and ultimately to the engine 105 within the hull of the watercraft. In many applications, the input shaft 106 is constantly spinning, as soon as the engine is started. The input shaft 106 can be configured in a substantially horizontal orientation, and can extend through the transom 102 of the boat 100, through the front or transom facing wall 30F of the standoff box 30 and into the interior 30I of the standoff box 30. The input shaft can be rotatably mounted in a bearing element 106G that is itself mounted and/or associated with the front wall 30F of the standoff box 30.

Optionally, the input shaft can include input shaft longitudinal axis ILA. This input shaft longitudinal axis can be parallel to and/or slightly offset relative to the reference line RL. The transfer shaft longitudinal axis TSA associated with the transfer shaft 50TS, as described further below, can be dynamically movable to a variety of angles relative to the input shaft longitudinal axis ILA. The input shaft longitudinal axis ILA can be and can remain substantially parallel to the secondary shaft longitudinal axis SLA. Of course, the various shafts can be slightly angled relative to one another, and not perfectly parallel to one another, depending on the application. Further, where additional universal joints or other articulating joints are included along a particular shaft, certain shaft portions may or may not be parallel to other portions of other shafts.

The drive assembly 50 can include one or more articulating joint connectors located within the standoff box that enable the transfer shaft to rotate and simultaneously reorient at multiple angles relative to the input shaft and/or secondary shaft during movement of the drive unit up or down, to the raised and lowered modes. As illustrated, the drive assembly can include a first articulating joint connector 55 at a first end E1 of the transfer shaft 50TS, and a second articulating joint connector 56 at a second end E2 of the transfer shaft. The respective ends of the transfer shaft can be movable toward and away from one another as detailed below.

The first articulating joint connector 55 can be joined with the input shaft 106, and the second articulating joint connector 56 can be joined with the secondary shaft 50SS. Each of the articulating joint connectors optionally can be in the form of a universal joint, also referred to as a U-joint or a Cardan joint, or any other similar joint or coupling that can transmit rotary power by a shaft over a range of angles. Further optionally, the universal joint can include a pair of hinges located close together, oriented at 90° to each other, connected by a cross shaft. The ends of the respective input shaft, transfer shaft and secondary shaft can include yokes to which the cross shafts respectively join.

In the embodiment shown in FIG. 5, the input shaft 106 can project into the interior 30I a fixed distance that optionally does not change during operation of the outdrive. The first universal joint 55 thus can remain at a first distance J1 from the front wall 30F during operation of the drive unit to raised and lowered modes. The second shaft 50SS can project into the interior 30I a fixed distance J2 that optionally does not change during operation of the outdrive. The second universal joint 56 thus can remain at a second distance J2 from the rear wall 30R during operation of the drive unit to raised and lowered modes. Of course, in some cases where the rear wall is curved or at another angle, the universal joint 56 can move relative to the rear wall, for example, toward or away from the front wall.

The universal joints enable the transfer shaft to remain rotatably coupled to the input shaft and the secondary shaft regardless of the angle between the longitudinal axes of the same as the outdrive transitions from raised to lowered mode or vice versa. For example, in the raised mode of the outdrive in FIG. 5, the longitudinal axis ILA of the input shaft can be at an angle TSA1 relative to the longitudinal axis TSA of the transfer shaft 50TS. This angle TSA1 in the raised mode optionally can be an obtuse angle, for example, between about 90° and 180°, further optionally about 100° to about 160°, even further optionally about 120° to about 140°. These angles however can change depending on the projection of the input shaft and secondary shaft into the interior 30I, as well as the characteristics of the transfer shaft 50TS.

In the raised mode, the longitudinal axis SLA of the secondary shaft can be at an angle TSA2 relative to the longitudinal axis TSA of the transfer shaft 50TS. Optionally, TSA1 can be equal to TSA2 which can be the case when the input shaft and secondary shaft are parallel to one another. The angle TSA2 in the raised mode optionally can be an obtuse angle, for example, between about 90° and 180°, further optionally about 100° to about 160°, even further optionally about 120° to about 140°. These angles however can change depending on the projection of the input shaft and secondary shaft into the interior 30I, as well as the characteristics of the transfer shaft 50TS.

When the outdrive 10 is reconfigured from the raised mode shown in FIG. 5 to the lowered mode shown in FIG. 6, the angle TSA1 changes to angle TSA3, and the angle TSA2 changes to the angle TSA4. This because the spatial relationship between the transfer shaft 50TS changes relative to each of the input shaft and secondary shaft upon movement from the raised mode to the lowered mode and vice versa. Indeed, the transfer shaft goes through a variety of angular orientations relative to these shafts during this operation. Thus, there can be multiple different values of the angles TSA3 and TSA4 during the transition.

Optionally, during the transition from the raised mode to the lowered mode, the angle between the transfer shaft and the input shaft can increase by optionally 40° to about 80°, or by different angles, depending on the application. This angle can be measured in a vertical plane and vertically above the respective longitudinal axes of the shafts as shown in FIGS. 5 and 6. Likewise, the angle between the transfer shaft and the secondary shaft can increase by optionally 40° to about 80°, or by different angles, depending on the application. The opposite can occur for each angle during the transition from the lowered mode to the raised mode, with the respective angles between the transfer shaft and the input shaft or secondary shaft decreasing during such transition.

Further optionally, during the transition from the raised mode to the lowered mode, and vice versa, the angle between the upper wall 30T of the standoff box 30 and the transfer shaft longitudinal axis TSA changes. This angle can decrease in the transition from the raised mode to the lowered mode. Optionally the transfer shaft longitudinal axis TSA can be at an acute angle in the raised mode, and generally parallel to the upper wall 30T in the lowered mode.

Even further optionally, the transfer shaft longitudinal axis TSA can remain substantially parallel to, and not changing its angle relative to, the lateral walls 30L of the standoff box, even when the drive unit is being raised and lowered.

The drive assembly 50 can include the transfer shaft 50TS shown in FIGS. 5 and 6. This transfer shaft 50TS is disposed in the interior 30I of the standoff box 30. The transfer shaft can include a first end E1 and a second opposing end E2. Each of these ends can be rotatably coupled to the respective input shaft and secondary shaft via the articulating joint connectors 55 and 56. Generally, the transfer shaft 50TS can be configured to rotate within the standoff box interior 30I throughout a variety of different spatial orientations and angles of its transfer shaft longitudinal axis TSA relative to the various walls of the standoff box. As it does, the ends of the transfer shaft can move differently from one another. For example, the end E1 can remain substantially stationary and not move relative to the upper or lower walls of the standoff box. In contrast, the second end E2 moves away from the upper wall 30T and toward the lower wall 30B during transition from the raised mode to the lowered mode, and in the opposite direction during transition from the lowered mode to the raised mode. Of course, the precise movement of this end E2 relative to the upper and bottom walls can be dictated by the initial orientation of the transfer shaft and its ability to extend and retract along its longitudinal axis.

As shown in FIGS. 5 and 6, the transfer shaft can include first and second shaft portions 57 and 58 joined with or at a sliding connection 59. The sliding connection can be in the form of a splined connection. A splined connection can be any type of keyed connection that enables the first and second portions to slide in directions S relative to one another, yet restrains rotation of the portions relative to one another, so that those portions do not rotate relative to one another.

Optionally, the second shaft portion 58 includes a splined end 58E. This splined end 58E can be disposed within a corresponding splined hole 57H defined by the first shaft portion 57. Via this splined connection, the first and second shaft portions are non-rotatable to another, yet can move toward and away from one another, or within one another along the transfer shaft longitudinal axis TSA. The first shaft portion and second shaft portion are generally movable linearly relative to one another along a transfer shaft longitudinal axis. Further, via the splined connection, the overall length of the transfer shaft can increase from a first length to a greater second length and vice versa, depending on movement to and from the relative raised and lowered modes. In addition, with this splined connection, the respective first and second portions can rotate in unison, in both the raised mode and the lowered mode and all positions therebetween.

As shown in FIGS. 5 and 6, the drive assembly 50 can include a bearing block 51. Bearing block can be movably mounted adjacent the rear wall 30R of the standoff box. The bearing block can define a secondary shaft mount bore 51B and a bearing element 51E mounted in the secondary shaft mount bore. The secondary shaft 50SS can be rotatably, and optionally slidably, mounted in the bearing element and the secondary shaft mount hole. In some cases, the secondary shaft 50SS can have a recessed area of a smaller diameter than the remainder of the secondary shaft. The shoulders adjacent this recess area can engage a portion of the bearing element and prevent the secondary shaft from moving outside desired tolerances. The bearing block can maintain the secondary shaft at a constant angle relative to an upper wall 30T of the standoff box when the drive unit moves from the raised mode to the lowered mode, and when the secondary shaft 50SS moves upward and downward within the elongated slot 33H in the rearward wall 30R during this movement.

The bearing block 51 can be non-rotatable within the interior 30I of the standoff box or relative to any other components of the standoff box. For example, the bearing block does not rotate relative to any of the walls of the housing 30H. The bearing block, however can be movable linearly along the rearward wall 30R of the standoff box as mentioned above. For example, the bearing block 51 can move along the rearward wall, optionally at least within a portion of the secondary shaft hole 33H from the raised mode shown in FIG. 5 to the lowered mode shown in FIG. 6. In this manner, bearing block 51 moves away from the upper wall 30T and toward the lower wall 30B of the housing 30H, when the drive unit 20 is moved from a raised mode shown in FIG. 5 to the lowered mode shown in FIG. 6. Optionally, the bearing block 51 moves downward within the interior when the drive unit moves from the raised mode to the lowered mode. Further optionally, the bearing block moves upward within the interior when the drive unit moves from the lowered mode to the raised mode.

The bearing block 51 can be configured so that it is movable linearly along the rearward wall 30R, toward and away from the bottom wall and/or the top wall. Optionally, the secondary shaft rotates relative to the bearing block, but not vice versa. The bearing block 51 also can be fixedly secured to and immovable relative to the mounting bracket 11. In this manner, when the mounting bracket is moved up by the vertical spacing actuator, the bearing block 51 moves with it to maintain the secondary shaft 50SS and its longitudinal axis of SLA in a predetermined angular orientation, for example horizontal and/or parallel to the upper wall 30T as shown. Further optionally, the bearing element can be any type of bearing system, such as ball bearings, roller bearings, and the like. Of course, in certain applications, such bearings can be eliminated and a decreased friction surface can be disposed between the bearing block and the secondary shaft.

As shown in FIGS. 5 and 6, the transfer shaft is rotatably coupled to the secondary shaft 50SS. The secondary shaft 50SS extends from the interior 30I of the standoff box, out through the secondary shaft hole 33H and into a housing 20H of the drive unit 20. The secondary shaft can be associated with the universal joint 56 on one end and on the other, non-rotatably joined with a secondary shaft gear 50SS2. When the transfer shaft rotates, it rotates the articulating joint, which rotates the attached secondary shaft 50SS, which rotates the secondary shaft gear associated with the second end of the secondary shaft 50SS. In turn, the secondary shaft 50SS also turns. As a result, due to the rotatable coupling of the transfer shaft 50SS to the driveshaft 50DS, this rotates the driveshaft 50DS and ultimately the propeller 107 as described further below.

More particularly, when it rotates, the secondary shaft 50SS engages a clutch 50C disposed in the housing 20H of the drive unit 20. This clutch 50C can be a cone clutch, and can be operated with a gear selecting fork (not shown). Via the clutch and the gear selector, a user can remotely, from elsewhere on the watercraft, for example, at a helm, adjacent a steering wheel, or at a control center of the watercraft inside or above the hull, select neutral, forward, or rearward propulsion via the outdrive. Exemplary cone clutches and gear selectors are disclosed in U.S. Pat. No. 6,960,107 to Schaub and U.S. Pat. No. 6,523,655 to Behara, both of which are incorporated by reference herein in their entirety. Of course, other types of clutches and gear selectors can be utilized. In some limited cases, the clutch 50C can be absent.

The clutch 50C, as illustrated, is rotatably coupled to the driveshaft 50DS. As mentioned above, the driveshaft is further rotatably coupled to the propeller shaft 23 which itself is not rotatably joined with the propeller 107. In operation, the input shaft 106 rotates the transfer shaft 50TS, which via the articulating connectors rotates the secondary shaft 50SS. The secondary shaft, via a second secondary shaft gear 50SS2 associated with a second end of the secondary shaft, engages two gears, associated with the shaft 50DS via the clutch, which can be rotatable relative to the shaft, with bearings between the components. The two gears individually engage the clutch 50C (but not at the same time) when the clutch 50C is moved up or down. The secondary shaft gear 50SS2 thereby transfers rotational force to the driveshaft 50DS through the gears and the clutch arrangement. Accordingly, upon rotation of the driveshaft 50DS, it in turn rotates the gears 24G and 23G, the propeller shaft 23 and the propeller 107. This rotation of all the elements of the drive assembly 50 occurs while the drive assembly is under power and rotating via input from the input shaft 106. The rotation of all these components can occur equally and similarly in both the raised mode and lowered mode of the lower drive unit.

Optionally, as used herein, the term driveshaft can refer to a unitary driveshaft of a single construction, as well as a driveshaft combined with a connector shaft to form a longer, overall shaft. As mentioned above, the driveshaft extends downwardly in the drive unit 20 and is rotationally coupled to the propeller shaft 23 via one or more gears 24G and 23G. Upon rotation of the driveshaft, the propeller shaft 23 and propeller rotate as well. Further optionally, as shown in FIG. 5, the secondary shaft 50SS can include a double universal joint 50DJ, which is described in more detail in the embodiments below and with reference to FIG. 8.

An aspect of the drive assembly 50 is that the transfer shaft can extend and retract linearly, to different lengths, and can articulate through a variety of angles relative to the input shaft and the secondary shaft at the respective universal joints, while still remaining rotatably coupled to the propeller shaft 23. Put another way, the driveshaft can continue to be rotatably coupled to the input shaft 106 and rotate, all while the drive unit 20 is in the raised or lowered mode and/or moving somewhere in between, and/or all while the transfer shaft changes in length between articulating joints at its opposing ends. The driveshaft continues to rotate the propeller 107 while the watercraft is under power and the input shaft 106 is rotating the various components of the drive assembly 50, in either the raised mode, the lowered mode, and during the transition from the raised mode to the lowered mode and vice versa. At all times, the driveshaft can continue to rotate the propeller regardless of the transitioning between the raised and/or lowered modes or vice versa. To do so, the drive unit 20 is vertically movable upward and downward relative to the standoff box as described herein.

As shown in FIGS. 5 and 6, the drive assembly is structured to provide linear extension and retraction of the portions of the transfer shaft relative to one another so that transfer shaft can continuously provide rotatable coupling between the input shaft and the secondary shaft, thereby providing rotational force sufficient to rotate the drive shaft and associated propeller shaft, while the drive assembly and outdrive are under power, and while the drive unit 20 is being moved from a raised mode shown in FIG. 5 to a lowered mode shown in FIG. 6. In effect, the propeller shaft effectively remains rotatably coupled to the input shaft through the transfer shaft, universal joints and spline connection of the drive assembly 50.

A second alternative embodiment of the outdrive is shown in FIGS. 8-12 and generally designated 210. The structure, function and operation of this embodiment are similar to the embodiments described above with several exceptions. For example, this embodiment includes a drive unit 220 joined with a transom 102 of a boat 100 via a standoff box 230. The standoff box 230 includes a portion of a drive assembly drive assembly 250, virtually identical to that described above, and the drive unit 220 includes the remainder of the drive assembly.

In this embodiment, however, standoff box 230 is situated on the transom 102 so that the reference line RL and the longitudinal axis LA of the propeller shaft 223 are in slightly different locations than the embodiment described above, relative to one another. For example, in the raised position in FIG. 8, the reference line RL is illustrated as being parallel to or slightly above the longitudinal axis LA. Optionally, the reference line RL can be offset 0 inches from the longitudinal axis LA. In other cases, the longitudinal axis LA can be disposed a preselected distance L4, for example 0, 1, 2, 3, 4, 5, 6 inches or increments thereof below the reference line RL.

Figure 8:
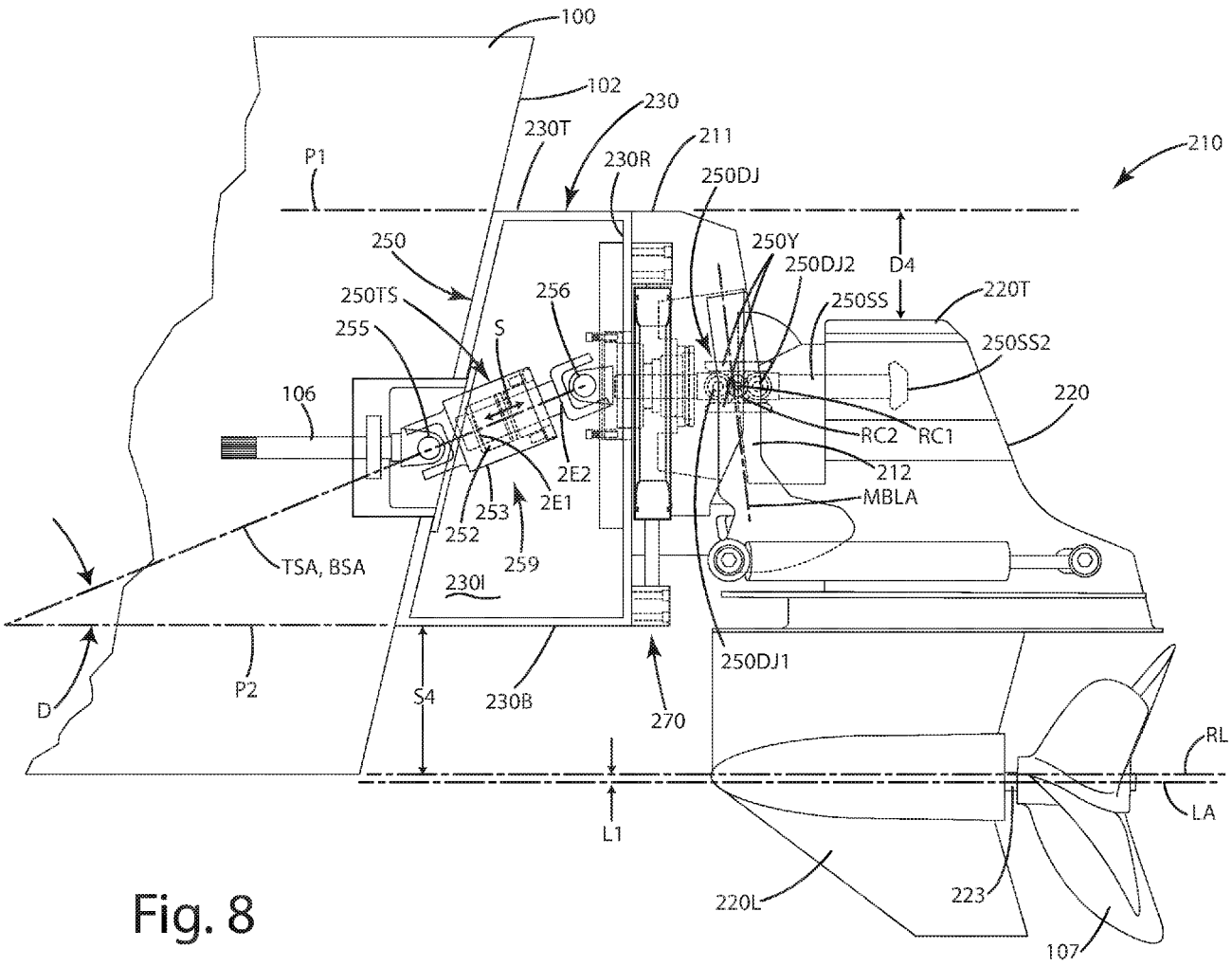
FIG. 8 is a side partial section view of a second alternative embodiment of the standoff box with a double universal joint and a vertical spacing assembly, with the outdrive in a raised mode.

Optionally, the longitudinal axis LA can be disposed a small preselected distance L4, for example 0, 1, 2, 3, 4, 5, 6 inches or increments thereof above the reference line RL in the raised mode shown in FIG. 8. Optionally, when the outdrive is in the raised mode, the propeller shaft 223, and particularly its longitudinal axis LA, is disposed a first distance S4 (FIG. 8) from the standoff box, and in particular, from the plane P2 in which the lowermost portion of the standoff box and/or lower wall 230B lays. This first distance S4 can extend, for example 0, 1, 2, 3, 4, 5, 6 inches or increments thereof, below the plane P2.

Figure 10:
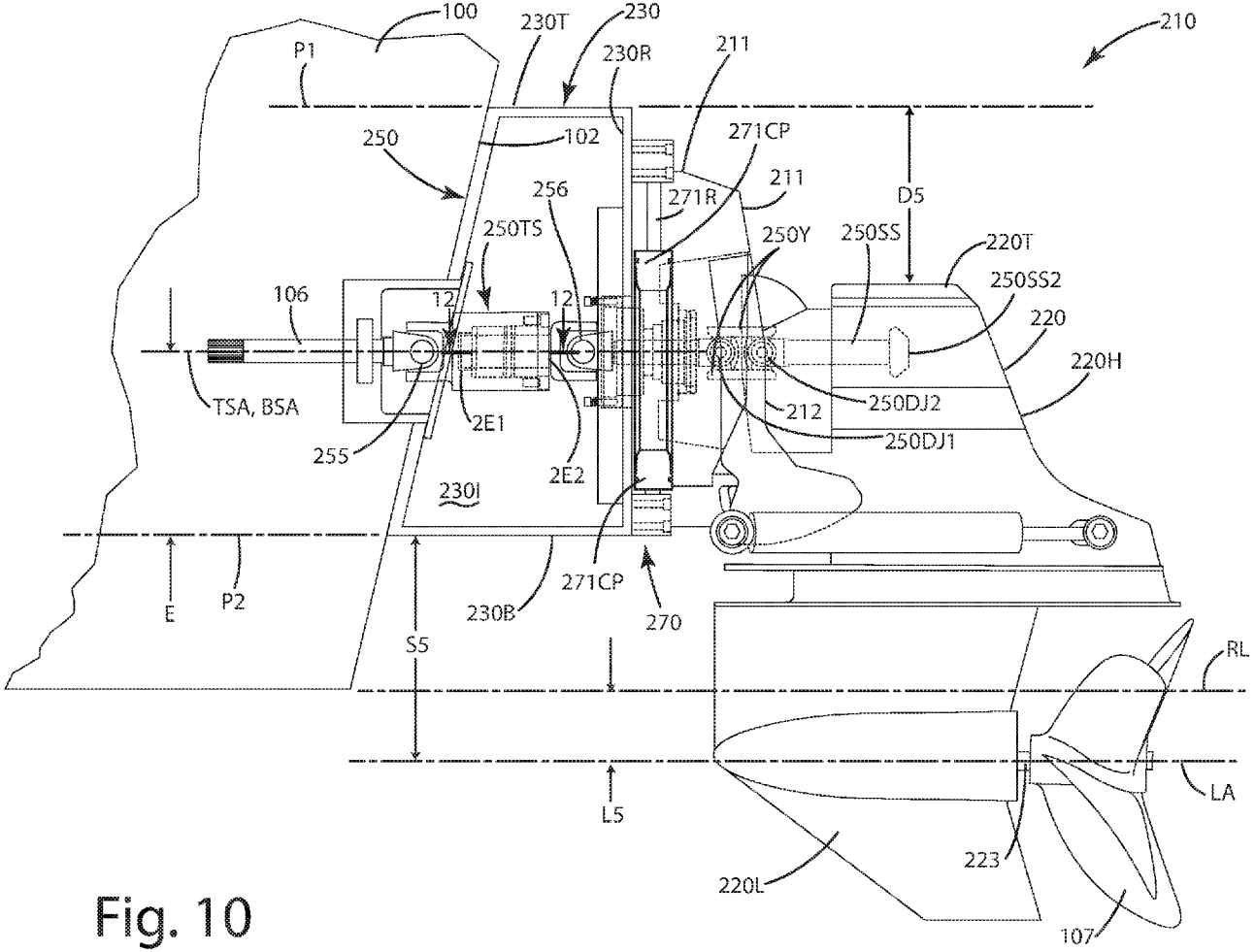
FIG. 10 is a side partial section view of a second alternative embodiment, with the outdrive in a lowered mode.

The drive unit 220 can be guided and urged with the vertical adjustment assembly 270 to a lowered mode as shown in FIG. 10. In this lowered mode, the top 220T of drive unit 220 moves downward relative to the upper wall 230T of the standoff box 230, and the plane P1 within which the uppermost portion of the standoff box and/or the upper wall lays, to a preselected distance D5. This distance D5 can be greater than distance D4, which is the distance between these elements when the outdrive 220 is in the raised mode shown in FIG. 8. This distance D5 can be optionally 0, 1, 2, 3, 4, 5, 6 inches or increments thereof.

In this lowered mode, shown in FIG. 10, the propeller shaft 223 and its longitudinal axis LA can be aligned in parallel to the reference line RL, particularly when the outdrive is in a neutral tilt position. In some cases, the longitudinal axis LA can be parallel to a plane within which the reference line RL lies in this lowered mode. In other cases, the longitudinal axis LA can be disposed a preselected distance L5, for example 0, 1, 2, 3, 4, 5, 6 inches or increments thereof below the reference line RL. Optionally, the longitudinal axis LA can be disposed a preselected distance L5, for example 0, 1, 2, 3, 4, 5, 6 inches or increments thereof above the reference line RL in the lowered mode shown in FIG. 10.

When the outdrive is in the lowered mode, the propeller shaft 223, and particularly, its longitudinal axis LA, can be disposed a second distance S5 from the standoff box, and in particular, from the plane P2 in which the lowermost portion of the standoff box and/or lower wall 230B lays. This second distance S5 can be greater than the first distance S4, for example 1, 2, 3, 4, 5, 6 inches or increments thereof greater than the first distance S4.

Optionally, the outdrive 220 also can be outfitted with another articulating connector, for example, a double universal joint 250DJ. This double universal joint can be disposed between the universal joint 256 and the secondary shaft gear 250SS2, optionally about midway between the first and second ends of the shaft 250SS. This effectively can divide the secondary shaft 250SS into first and second portions that can be parallel and aligned with one another, or can be offset at some angle relative to a horizontal plane and/or a vertical plane when the outdrive 220 is rotated in a watercraft turning operation or tilted during a tilting operation, respectively. The double universal joint 250DJ can include center yokes 250Y that join two opposing universal joints 250DJ1 and 250DJ2, allowing the double universal joint to operate similar to a homokinetic or constant velocity joint. The double universal joint 250DJ can include a center of rotation RC1. This center of rotation RC1 can be in the same location as a center of rotation RC2 of the gimbal ring 212. With this double universal joint construction and common location of the two centers of rotation, the outdrive 220 can be tilted with minimal strain and minimal stress. Further minimal inefficiencies are born by the rotating secondary shaft and other components during that tilting operation.

The outdrive also can be turned left or right in a watercraft turning operation. To ensure that minimal strain, minimal excessive torque and/or minimal inefficiencies are born by the rotating secondary shaft during that turning operation, the center of rotation RC1 also can be located on an axis of rotation MBLA, which corresponds to an axis about which the outdrive and gimbal ring can rotate relative to the mounting bracket 211, as shown in FIG. 8.

The outdrive 220 can be outfitted with a different vertical adjustment assembly 270 than that described above in connection with the other embodiments. As shown in FIGS. 8-11, the vertical adjustment assembly 270 is the component of the outdrive 220 that moves the drive unit vertically, and generally relative to the standoff box 230. Depending on the particular application, the various components of the vertical adjustment assembly can be joined with the mounting bracket 211 and the standoff box 230 respectively. Further, the vertical adjustment assembly can be operated remotely, for example, from a cabin, a helm, near a steering wheel and/or at an operator station via electrical, manual, hydraulic pneumatic or other controls to provide the desired raising and/or lowering of the outdrive relative to the standoff box.

Figure 9:
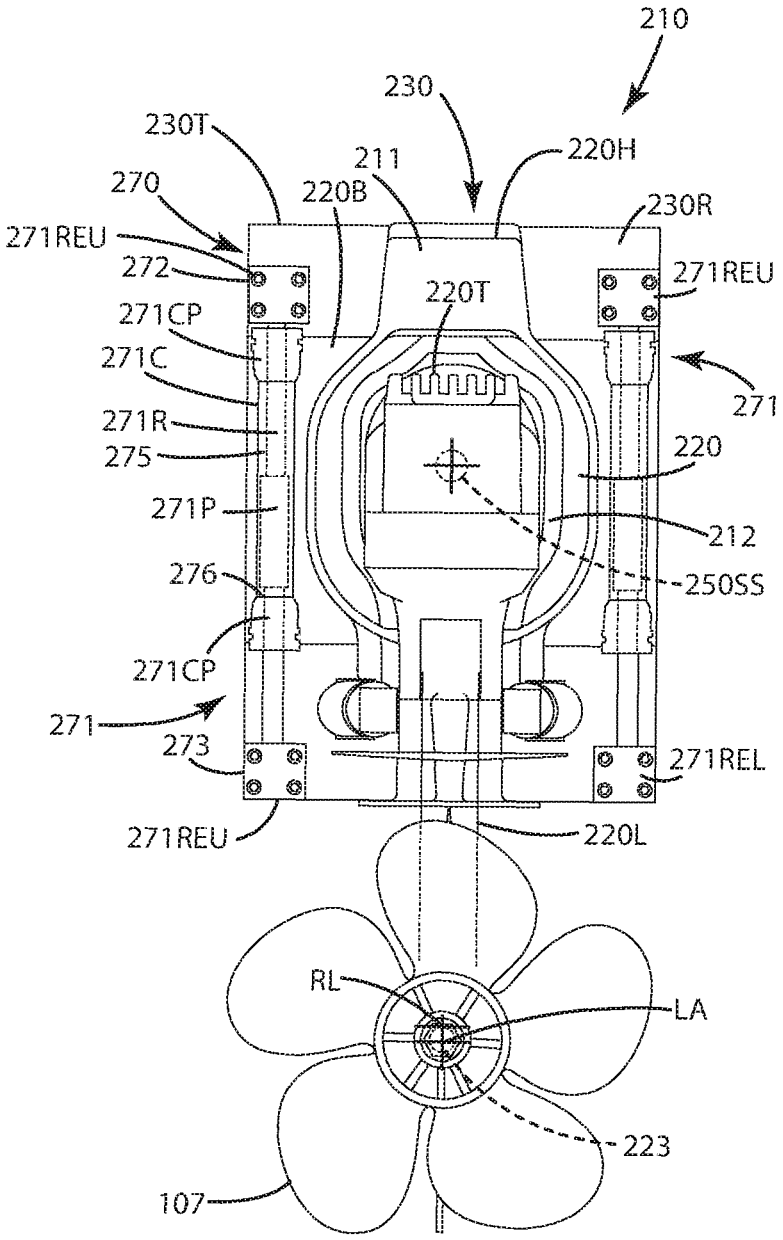
FIG. 9 is a rear view thereof.
Figure 11:
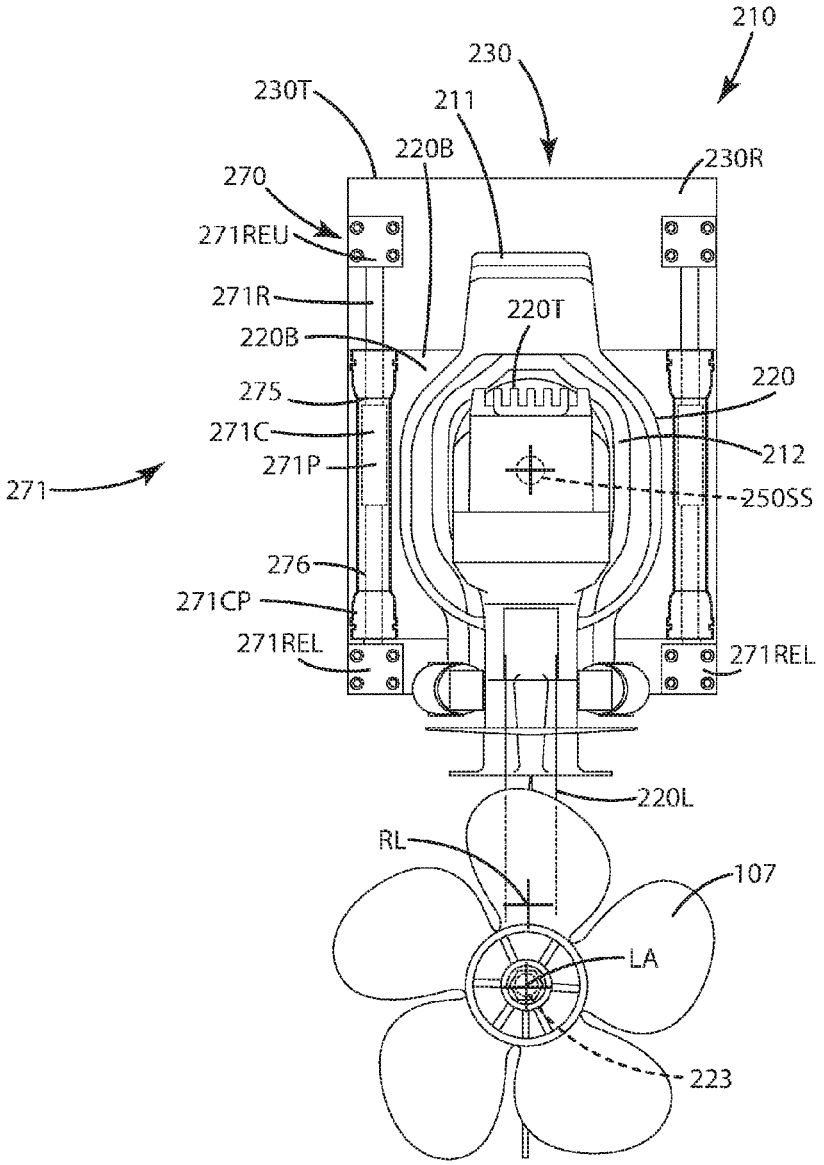
FIG. 11 is a rear view thereof.

With reference to FIGS. 9 and 11, the vertical adjustment assembly 270 can be joined with and/or included as part of the standoff box, and optionally the rear wall 230R, as well as the mounting bracket 211. In this embodiment, the rear wall 230R can be substantially vertical, and optionally perpendicular to the top and bottom walls of the standoff box 230. Further, this rear wall can be non-parallel to the standoff box front wall and/or the transom.

The vertical adjustment assembly 270 can include first and second actuators 271. These actuators can be virtually identical to one another, and located on opposite sides of the propeller longitudinal axis LA. The actuators 271 also can be disposed symmetrically across from one another on opposite sides of the standoff box 230. This can provide a balanced application of force to raise and lower the drive unit 220 relative to the standoff box 230.

Due to their similar construction, only one of the actuators will be described herein. The actuators 271 can be in the form of hydraulic, pneumatic or other types of cylinders with a piston 271P fixedly mounted and optionally immovable relative to a ram or rod 271R. The rod 271R can include upper 271REU and lower ends 271REL as shown in FIGS. 9 and 11. Each of these ends can be fixedly and immovably joined with the standoff box 230, for example, its rear wall, optionally via brackets 272 and 273. In this manner, the rods and brackets are immovable relative to the rear wall or standoff box in general. The brackets themselves can be fastened with fasteners or other devices to the standoff box.

The piston 271P can be disposed within a cylinder 271C that is defined by a block 220B or other part that is fixedly included in or joined with the transom mount 211. One or more end caps 271CP can close off the opposing ends of the cylinder 271C. The caps can include sealed openings that enable the rod 271R to extend therethrough. Cavities 275, 276 can be formed between the piston 271P and the caps 271CP adjacent opposing ends of the piston. The filling and emptying of these cavities with fluid can effectively push the caps 271CP away from the piston 271P. Because the caps are fixedly mounted to the block 220B and the mount 211, and the piston is in a fixed position relative to the rod, this movement causes these elements and the outdrive 220 to move relative to the standoff box 230 and its rear wall 230R.

For example, as shown in FIG. 9, when the outdrive 220 is in a raised position and it is suitable to lower the outdrive, a user can operate a control that introduces fluid into the cavity 276 and expels fluid from cavity 275. This causes the bottom cap 271CP to move downward away from the piston 271P, and the top cap to move toward the piston. The caps are joined with the block, mount and outdrive, and accordingly these elements move downward relative to the standoff box and its rear wall. This continues until a desired lowering level of the outdrive 220 is achieved, for example, when the level shown in FIGS. 10 and 11 is achieved, where the piston 271P is at the top of the cylinder, optionally abutting the top cap 271CP. Of course, an infinite number of levels can be achieved via movement of the piston within the cylinder. Thus, the propeller shaft and its axis can be moved relative to the reference line to precisely orient the thrust of the outdrive depending on the application.

Optionally, the left and right actuators 271 can be in a common fluid or hydraulic circuit so that the actuators simultaneously, consistently and evenly move the block 220B and mounting plate 211 to move these elements, and the drive unit 220, along with all of its components, in an even and level manner upward and downward to and from the various modes.

Further optionally, the precise fitment of the pistons in the cylinders, and movement of the caps relative to the rods, can provide a level of guidance. In some cases, these elements of the vertical adjustment assembly 270 can provide a smooth, guided and even consistent raising and lowering of the outdrive 220 relative to the standoff box 230. Of course, other types of guides, such as rods, bars or the like can be added to the construction and/or substituted for the elements of the vertical adjustment assembly to provide a guiding interface so that the outdrive can move consistently and evenly, and a non-binding manner relative to the standoff box, when moving from the raised mode to the lowered mode and vice versa.

Figure 12:
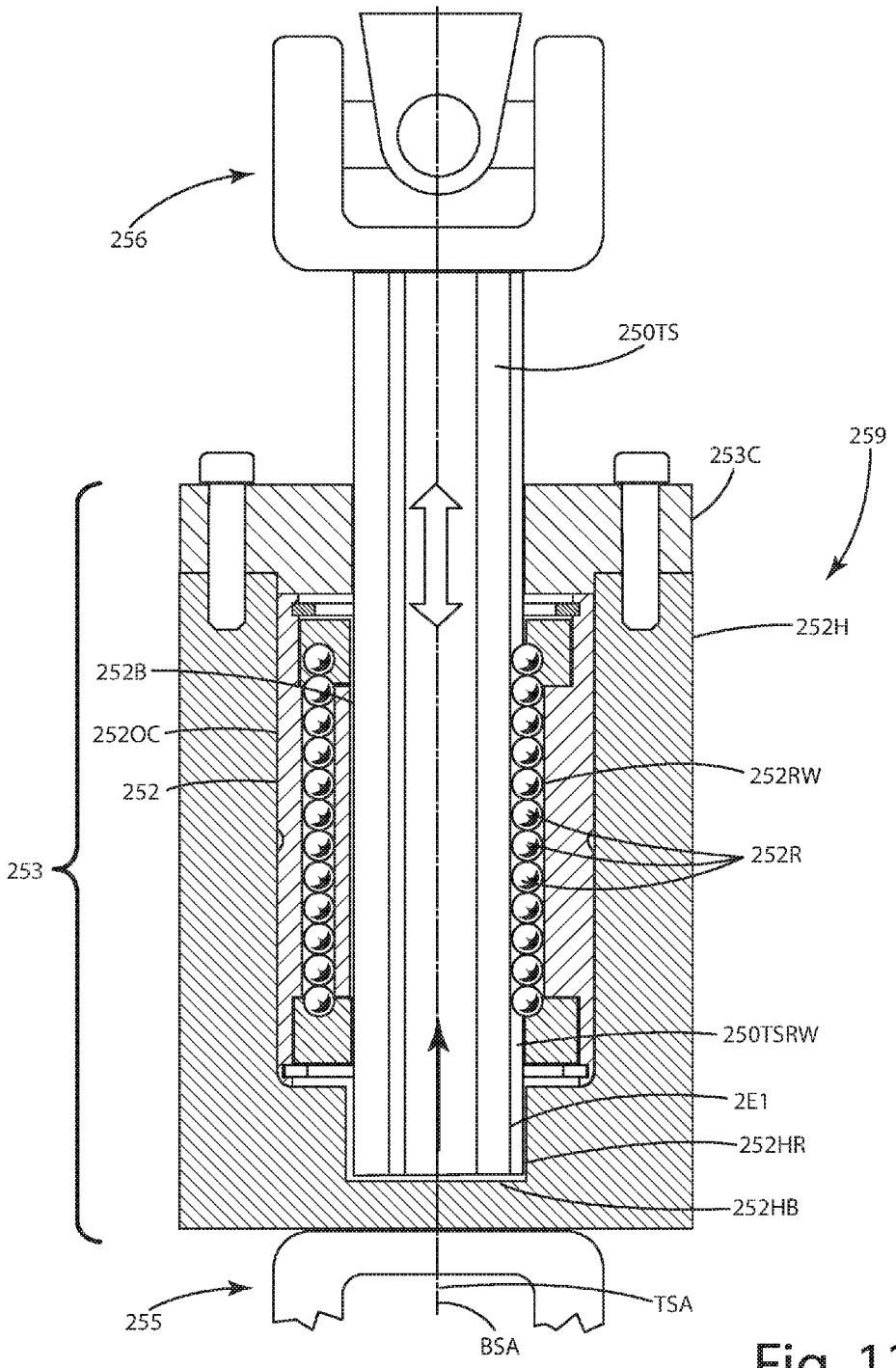
FIG. 12 is a section view of a ball spline illustrating bearing elements therein interacting with a transfer shaft, so that the transfer shaft can move linearly through the ball spline, but is non-rotatable relative to the ball spline, taken along line 12-12 of FIG. 10.

As shown in FIGS. 8-12, the drive assembly 250 can function and include the same or similar components as the drive assembly 50 in the embodiment above. The various components of the drive assembly 250 also can move through the various angles and orientations, mentioned in the embodiment above, relative to the components of the standoff box in raising and lowering the drive unit. Those angles and spatial orientations are virtually identical, so they will not be described again here. The sliding connector 259 and transfer shaft 250TS of the embodiment, however, can be different in structure. As shown in FIGS. 8, 10 and 12, the transfer shaft 250TS is disposed in the interior 230I of the standoff box 230. The transfer shaft can include a first end 2E1 and a second opposing end 2E2. Each of these ends can be rotatably coupled to the respective input shaft 106 and secondary shaft 250SS via the articulating joint connectors 255 and 256, and with regard to the first end 2E1, via the ball spline unit 253 joined with the joint connector 255.

Generally, the transfer shaft 250TS can be configured to rotate within the standoff box interior 230I throughout a variety of different spatial orientations and angles of its transfer shaft longitudinal axis TSA relative to the various walls of the standoff box. As it does, the ends of the transfer shaft can move differently from one another. For example, the end 2E1 can move through the ball spline unit 253, sliding away from the articulating joint connector 255, and simultaneously can move away from the bottom wall and the front wall of the standoff box when the drive unit 220 moves from a lowered position in FIG. 10 to a raised position in FIG. 8. The second end 2E2 can move toward the upper wall 230T and away from the lower wall 230B during transition from the lowered mode to the raised mode. Of course, the movement of these ends is the opposite when the drive unit 220 moves from the raised position to the lowered position. Further, the precise movement of the ends 2E1 and 2E2 relative to the upper and bottom walls can be dictated by the initial orientation of the transfer shaft and its ability to extend and retract along its longitudinal axis.

As shown in FIG. 8, the transfer shaft 250TS is slidably joined with the ball spline unit 253 at a sliding connection 259. In operation, the transfer shaft 250TS slides linearly in directions S along the axis TSA into and out from the ball spline unit to varying degrees depending on the movement of the drive unit 220. During the sliding, the end 2E1 can slide away from the articulating joint 255 or toward that joint. The other end 2E2 can remain stationary, at a fixed distance from the articulating joint 256, or adjacent that joint. The transfer shaft and ball spline also are non-rotatably joined with one another, so that those portions do not rotate relative to one another and so these elements rotate in unison. Further, via the sliding connection 259, the overall length of the transfer shaft/ball spline unit can increase from a first length to a greater second length, or decrease from a greater second length to a lesser first length, depending on movement to and from the relative raised and lowered modes. In addition, with this sliding connection, the respective first and second portions can rotate in unison, in both the raised mode and the lowered mode and all positions therebetween.

The ball spline unit 253 is further illustrated in FIG. 12. As shown there, the ball spline unit includes a ball spline 252 defining a bore 252B in which the transfer shaft 250TS is slidably disposed, but rotationally fixed, that is, the transfer shaft 250TS does not rotate in the bore 252B. The ball spline 252 can be fixedly and immovably joined with the housing 252H, which is further fixedly and immovably joined with and/or part of the articulating joint 255. The ball spline 252 can include an outer cylinder 252OC. The outer cylinder 252OC can be joined with a cap 253C, which can be fastened, welded, integrated with or otherwise joined non-rotatably to the housing 252H. In this manner, all of the components 252, 252OC, 253C, 252H and 255 can be non-rotatably fixed or joined with one another. Accordingly, when the articulating joint 255 rotates, the ball spine unit 253 also rotates in unison. Optionally, the housing includes a clearance recess 252HR sized to receive part of the end 2E1 of the transfer shaft 250TS. In operation, when the drive unit moves, the end 2E1 moves into or out from the recess, when it is included in the construction. For example, when the unit 220 is raised, the transfer shaft 250TS moves with the articulating joint 256 away from the articulating joint 255. The end 2E1 of the transfer shaft thus can be pulled out of the housing recess 252HR, away from its bottom 252HB, generally away from the first articulating unit 255 and/or generally away from the input shaft. When the unit is lowered, the movement described above is reversed.

As illustrated, the ball spline 252 can be any suitable type of ball spline. Generally, the transfer shaft 250TS can move linearly through the ball spline and its internal bore 252B along a ball spline axis BSA, which can be parallel to and coincident with the transfer shaft axis TSA. The ball spline 252 can define a first bearing raceway 252RW that is in communication with the internal bore, that is, objects within the first bearing raceway 252RW can move into and out from the internal bore 252B or portions thereof. The ball spline also includes multiple bearing elements 252R, which is illustrated are the forms of balls, such as ball bearings that are spherical in shape. These balls 252R are disposed in the first bearing raceway 252RW. The transfer shaft 250TS is likewise configured with a groove 250TSRW. This groove effectively forms a second raceway. The second raceway is in communication with the first raceway 252RW. Accordingly the balls or bearings 252R can move and/or roll in the first raceway and in the second raceway, and/or can move from one raceway to another, depending on relative movement of the transfer shaft relative to the ball spline.

Via the interaction of the balls with the first raceway in outer cylinder 252OC, as well as the second raceway 250TSRW defined by the connector shaft and/or driveshaft, the transfer shaft can telescope relative to or otherwise move linearly through the ball spline 252 and relative to the ball spline unit 253. In turn, the transfer shaft is linearly movable relative to, and optionally through, the ball spline and its internal bore when the drive unit 220 is moved from the raised mode to the lowered mode and vice versa. Due to the ball spline's interaction with the shaft however, that shaft is rotationally fixed, that is, the shaft does not rotate relative to the ball spline. Accordingly, the ball spline and transfer shaft rotate in unison, in both the raised mode and the lowered mode and all positions therebetween. Further, the ball spline unit and transfer shaft also rotate in unison with the first and second articulating joints and their components.

Optionally, the ball spline unit and the transfer shaft can attain a variety of spatial and angular orientations relative to the standoff base walls when the drive unit is raised or lowered. For example, as shown in FIG. 8, when the unit 220 is raised, the ball spline axis BSA and the transfer shaft axis TSA can attain an angle D relative to the plane P2 associated with the bottom wall 230B. This angle can be an acute angle of optionally 1° to 30°, further optionally 5° to 25°, and even further optionally about 22.5°. As shown in FIG. 10, when the unit 220 is lowered, the ball spline axis BSA can attain an orientation and an associated second angle E, which as shown can be zero, so the axes BSA and/or TSA and associated components are aligned with or parallel to the plane P2 associated with the bottom wall 230B. Of course, other angles E, acute, right or obtuse, are possible depending on the application and the configuration of the components of the outdrive.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An outdrive for a watercraft having an inboard engine, the drive comprising:

an input shaft extending through a transom of the watercraft, away from an engine located within a hull of the watercraft, a standoff box disposed rearward of the transom and fixed in a stationary position relative to the transom, the input shaft extending into an interior of the standoff box;

a transfer shaft located in the interior of the standoff box, the transfer shaft rotatable in response to rotation of the input shaft, the transfer shaft including a transfer shaft longitudinal axis, a first transfer shaft portion and a second transfer shaft portion, the first transfer shaft portion and second transfer shaft portion being slidably joined with one another at a sliding connection so that the first and second transfer shaft portions can move toward and away from one another along the transfer shaft longitudinal axis;

a secondary shaft rotatable in response to rotation of the transfer shaft, the secondary shaft extending from the standoff box;

a drive unit extending rearward from the standoff box, the secondary shaft extending into the drive unit, the drive unit including a driveshaft rotatable upon rotation of the secondary shaft, a propeller shaft rotatable upon rotation of the driveshaft, and a propeller joined with the propeller shaft and adapted to rotate therewith, thereby producing thrust to propel the watercraft through a body of water;

wherein the drive unit is operable in a raised mode, in which the propeller shaft is disposed a first distance from the standoff box, and in a lowered mode, in which the propeller shaft is disposed a second distance, greater than the first distance, from the standoff box.

2. The outdrive of claim 1 comprising:

a first articulating joint connector at a first end of the transfer shaft;

a second articulating joint connector at a second end of the transfer shaft, the second end distal from the first end, wherein the first articulating joint connector is joined with the input shaft, wherein the second articulating joint connector is joined with the secondary shaft.

3. The outdrive of claim 1, wherein the transfer shaft includes a first end and a second end distal from the first end, wherein the first end is associated with the first transfer shaft portion and the second end is associated with the second transfer shaft portion, wherein the first transfer shaft portion includes a spline, wherein the second transfer shaft portion defines a corresponding spline hole, wherein the spline is slidably disposed in the spline hole.

4. The outdrive of claim 3 comprising:

a vertical spacing actuator including a first end joined with a rearward wall of the standoff box, the vertical spacing actuator including a second end joined with the drive unit, wherein the vertical spacing actuator is configured to move the drive unit from the raised mode to the lowered mode by moving the first end relative to the second end, all while the standoff box remains fixed to and stationary relative to the transom.

5. The outdrive of claim 1 comprising:

a bearing block movably mounted adjacent a rear wall of the standoff box, the bearing block including a secondary shaft mount bore and a bearing element mounted in the secondary shaft mount bore, wherein the secondary shaft is rotatably mounted in the bearing element and the secondary shaft mount hole, wherein the secondary shaft extends from the interior of the standoff box, through the bearing block and into a housing of the drive unit, wherein the bearing block maintains the secondary shaft at a constant angle relative to an upper wall of the standoff box when the drive unit moves from the raised mode to the lowered mode.

6. The outdrive of claim 5, comprising:

a first universal joint joining the transfer shaft and the input shaft;

a second universal joint joining the transfer shaft and the secondary shaft; and a third universal joint disposed rearward of the standoff box in the outdrive, the third universal joint being a double universal joint.

7. The outdrive of claim 1, comprising:

a first universal joint joining the transfer shaft and the input shaft;

a second universal joint joining the transfer shaft and the secondary shaft; and a third universal joint disposed rearward of the standoff box in the outdrive, the third universal joint being a double universal joint.

8. The outdrive of claim 1, comprising:

an input shaft longitudinal axis of the input shaft, wherein the input shaft longitudinal axis is substantially parallel to the transfer shaft longitudinal axis when the drive unit is in the lowered mode, wherein the input shaft longitudinal axis is transverse to the transfer shaft longitudinal axis when the drive unit is in the raised mode.

9. The outdrive of claim 8, comprising:

a secondary shaft longitudinal axis of the secondary shaft, wherein the secondary shaft longitudinal axis is substantially parallel to the transfer shaft longitudinal axis when the drive unit is in the lowered mode, wherein the secondary shaft longitudinal axis is transverse to the transfer shaft longitudinal axis when the drive unit is in the raised mode, wherein the secondary shaft includes a constant velocity joint between first and second portions of the secondary shaft.

10. The outdrive of claim 1, comprising:

a tilt actuator configured to tilt the drive unit upward and downward; and a vertical spacing actuator configured to move the drive unit from the raised mode to the lowered mode.

11. A standoff box for a watercraft having an inboard engine, the standoff box comprising:

a housing defining an interior, the housing including a transom facing wall, a bottom wall and a rearward wall, the transom facing wall defining an input shaft hole adapted to receive therethrough an input shaft extending from an inboard motor, the transom facing wall configured to be fixedly and immovably joined to a transom to the watercraft, the rearward wall defining a secondary shaft hole adapted to receive therethrough a secondary shaft extending to an outdrive, the secondary shaft hole including a secondary shaft hole axis;

a transfer shaft disposed in the interior of the housing, the transfer shaft configured to rotate in response to rotation of the input shaft, the transfer shaft including a transfer shaft longitudinal axis, the transfer shaft including an end and a sliding connector configured to enable the end to move toward and away from a first articulating joint along the transfer shaft longitudinal axis; and a secondary shaft rotatable in response to rotation of the transfer shaft, the secondary shaft extending from the housing through the secondary shaft hole, the secondary shaft movable linearly along the secondary shaft hole axis so that the secondary shaft is movable toward and away from the bottom wall of the housing as the secondary shaft rotates.

12. The standoff box of claim 11, comprising:

a ball spline unit included in the sliding connector, wherein the ball spline unit includes a ball spline housing joined with a portion of the articulating joint, wherein the ball spline unit includes a ball spline having a bore, with the transfer shaft slidably disposed in the bore, but being non-rotatable relative to the ball spline so that the ball spline and transfer shaft rotate in unison.

13. The standoff box of claim 11, wherein the transfer shaft includes a first shaft portion and a second shaft portion joined via a spline connection, wherein the first shaft portion and second shaft portion are movable linearly relative to one another along a transfer shaft longitudinal axis, wherein the first portion includes the end.

14. The standoff box of claim 11 comprising:

a ball spine unit associated with the transfer shaft and configured to enable a second articulating joint to move toward and away from the first articulating joint.

15. The standoff box of claim 11 comprising:

a second universal joint joining the transfer shaft and the secondary shaft, wherein the first articulating joint is a first universal joint joining the transfer shaft and the input shaft.

16. A method of operating an outdrive for a watercraft, the method comprising:

rotating an input shaft extending from a transom of a watercraft;

rotating a transfer shaft coupled to the input shaft, the transfer shaft disposed in a standoff box having a bottom wall;

rotating a secondary shaft coupled to the transfer shaft, the secondary shaft disposed in the standoff box;

rotating a driveshaft coupled to the secondary shaft, the driveshaft disposed in an outdrive;

rotating a propeller shaft coupled to the driveshaft, the propeller shaft joined with a propeller; and moving the propeller shaft away from the bottom wall of the standoff box while rotating the driveshaft and propeller shaft, the moving occurring while the propeller spins and the watercraft is moving through a body of water, wherein during the moving step, the transfer shaft moves from a first angle to a second different angle relative to the bottom wall of the standoff box, and the standoff box remains stationary relative to the transom.

17. The method of claim 16 comprising:

moving a spline within a corresponding spline hole during the step of moving the propeller shaft away from the bottom wall.

18. The method of claim 16 comprising:

rotating a first universal joint joining the transfer shaft and the input shaft; and rotating a second universal joint joining the transfer shaft and the secondary shaft.

19. A watercraft comprising:

a hull including a bow and a stern, with a transom located at the stern;

a reference line projecting rearward from a lowermost portion of the transom;

an engine disposed in the hull;

an input shaft extending away from the engine and outwardly from the transom;

a standoff box including an interior and a bottom wall, the standoff box being fixedly joined in a stationary position with the transom;

a transfer shaft rotatably mounted in the interior and rotatably coupled to the input shaft;

a first articulating joint joining the transfer shaft and the input shaft;

a secondary shaft rotatable in response to rotation of the transfer shaft, the secondary shaft extending rearward from the standoff box;

a second articulating joint joining the transfer shaft and the secondary shaft;

a drive unit joined with the standoff box, the drive unit including a driveshaft rotatably coupled to the secondary shaft, the drive unit including a propeller shaft and a propeller, the propeller shaft rotatably coupled to the driveshaft;

wherein the drive unit is movable upward and downward while the watercraft is moving through a body of water and while the propeller is rotating so as to move the propeller shaft relative to the reference line while maintaining the propeller shaft in a fixed angular relationship relative to the reference line, whereby movement of the drive unit upward raises a thrust point of the watercraft as the watercraft is moving through the body of water.

20. The watercraft of claim 19, comprising:

a ball spine unit associated with the transfer shaft and configured to enable the second articulating joint to move toward and away from the first articulating joint.

* * * * *